US008477130B2

(12) United States Patent
Hashimoto

(10) Patent No.: US 8,477,130 B2
(45) Date of Patent: Jul. 2, 2013

(54) DISPLAY DEVICE

(75) Inventor: Kazuyuki Hashimoto, Minato-Ku (CN)

(73) Assignee: TPO Hong Kong Holding Limited, Hong Kong (CN)

( * ) Notice: Subject to any disclaimer, the term of this patent is extended or adjusted under 35 U.S.C. 154(b) by 913 days.

(21) Appl. No.: 12/089,932

(22) PCT Filed: May 9, 2006

(86) PCT No.: PCT/JP2006/309335
§ 371 (c)(1),
(2), (4) Date: Apr. 11, 2008

(87) PCT Pub. No.: WO2006/123552
PCT Pub. Date: Nov. 23, 2006

(65) Prior Publication Data

US 2010/0134460 A1 Jun. 3, 2010

(30) Foreign Application Priority Data

May 18, 2005 (JP) ..... 2005-145582

(51) Int. Cl.
*G09G 3/36* (2006.01)
*G09G 5/00* (2006.01)

(52) U.S. Cl.
USPC ..... 345/211; 345/89; 345/90; 345/98

(58) Field of Classification Search
USPC ..... 345/211, 90, 98
See application file for complete search history.

(56) References Cited

U.S. PATENT DOCUMENTS

| | | | | |
|---|---|---|---|---|
| 6,967,649 | B2 * | 11/2005 | Sun | 345/211 |
| 7,002,568 | B2 * | 2/2006 | Morita | 345/211 |
| 2002/0180675 | A1 * | 12/2002 | Tobita et al. | 345/87 |
| 2002/0196247 | A1 * | 12/2002 | Miyazawa et al. | 345/211 |
| 2003/0016201 | A1 * | 1/2003 | Ayres et al. | 345/98 |
| 2003/0016202 | A1 * | 1/2003 | Edwards et al. | 345/98 |
| 2004/0130543 | A1 * | 7/2004 | Sun | 345/211 |
| 2004/0252116 | A1 * | 12/2004 | Tobita | 345/211 |
| 2006/0044301 | A1 * | 3/2006 | Ha | 345/209 |
| 2008/0024481 | A1 * | 1/2008 | Lee et al. | 345/212 |
| 2009/0135170 | A1 * | 5/2009 | Hashimoto | 345/211 |

FOREIGN PATENT DOCUMENTS

| | | | |
|---|---|---|---|
| JP | 07-253764 | A | 10/1995 |
| JP | 2001-022315 | | 1/2001 |
| JP | 2002229532 | A1 | 8/2002 |
| JP | 1523551 | | 8/2004 |
| WO | WO-2004/090854 | | 10/2004 |

* cited by examiner

*Primary Examiner* — Bipin Shalwala
*Assistant Examiner* — Benyam Ketema
(74) *Attorney, Agent, or Firm* — Morris Manning & Martin LLP; Tim Tingkang Xia, Esq.

(57) ABSTRACT

A display device capable of driving at low power consumption is provided. In a display device (1) for displaying images by supplying voltages on the sub-pixel electrode (Ep) and the common electrode (Ecom), the display device (1) includes a voltage selection circuit (102) for receiving first and second refresh voltages (4V and −5V). The voltage selection circuit (102) supplies the first refresh voltage (5V) on the sub-pixel electrode (Ep) through a first current path (Pa) when the data voltage on the sub-pixel electrode (Ep) is −5V, while the second refresh voltage (−5V) is supplied to the sub-pixel electrode (Ep) through a second path (Pb) when the data voltage on the sub-pixel electrode (Ep) is 5V.

9 Claims, 12 Drawing Sheets

DISPLAY DEVICE

CROSS REFERENCE TO RELATED APPLICATIONS

This Non-provisional application claims priority of PCT Patent Application No(s). PCT/JP2006/309335.

BACKGROUND OF THE INVENTION

1. Field of Invention

The present invention related to a display device for displaying images by applying voltages to first and second electrodes.

2. Related Art

Conventionally, known is a display device comprising electro-optical medium interposed between top electrodes and bottom electrodes and for displaying images by applying voltage between the top and bottom electrodes. One type of such display device is an inverted driving display device. The inverted driving scheme can be classified into, for example, (1) a type of applying voltages that vary in voltage level to both of the top and bottom electrodes and (2) a type of applying a constant voltage to one of the top and bottom electrodes wile varying the voltage level to be applied to the other electrodes.

As a result of rapid popularization of display devices for cellular phones or the like in recent years, there are strong needs to reduce power consumption of such display devices. In order to meet the needs, for example, WO 2004-090854A1 discloses a display device in which each pixel is provided with a refresh circuit.

The refresh circuit as disclosed in WO 2004-090854A1 can be applied to display devices of the aforementioned type (1). However, the invention as disclosed in WO 2004-090854A1 cannot be applied to display devices of the aforementioned type (2). Display devices of the above type (2) are applied more than those of the above type (1) because of improved display quality. It is, therefore, desirable to reduce power consumption of the display devices that employ the display scheme of the above type (2).

SUMMARY OF THE INVENTION

It is an object of the present invention to provide a display device that solves the aforementioned problem.

In order to achieve the above object, the display device according to the present invention is designed to display images by applying voltages to first and second electrodes and is provided with voltage selection means for receiving first and second refresh voltages for applying the first refresh voltage on the first electrodes through a first path when the voltage on the first electrodes is a first data voltage, while applying the second refresh voltage on the first electrodes through a second path when the voltage on the first electrodes is a second data voltage.

Because of the provision of the voltage selection means, the first and second refresh voltages can be applied to the first electrode through the first and second paths, respectively. Application of the first and second refresh voltages to the first electrodes enables to drive the display device at low power consumption.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Although the present invention will be described hereunder by way of an exemplified color display device, it is to be noted that the present invention can be applied to, for example, a monochrome display device.

Figure 1:
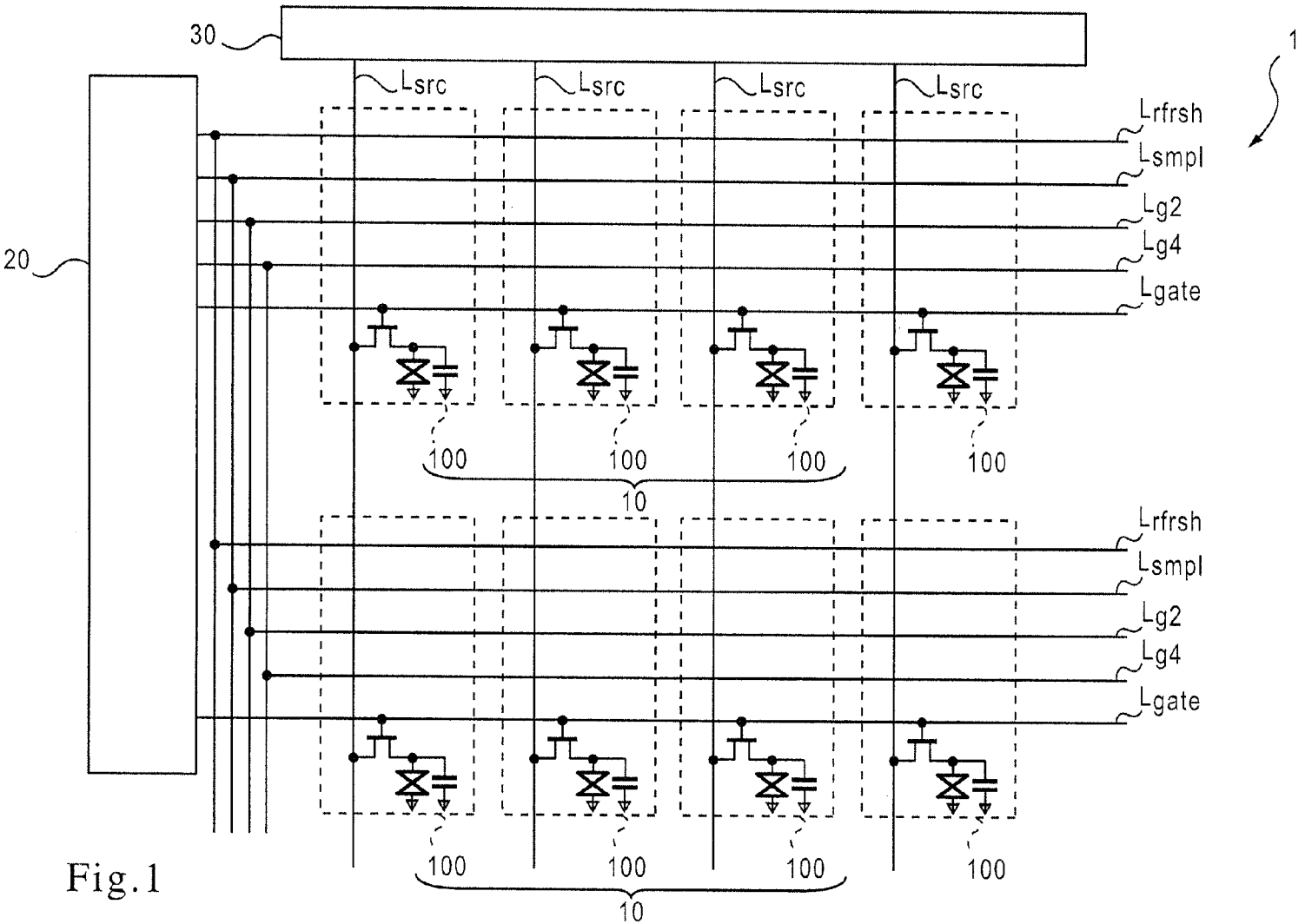
FIG. 1 is a simplified schematic of the display device 1 according to one embodiment of the present invention.

FIG. 1 is a simplified schematic of a display device 1 according to one embodiment of the present invention.

The display device 1 has RGB sub-pixels disposed in matrices. Only eight sub-pixels 100 are shown in FIG. 1 for convenience of description. These sub-pixels 100 form a single pixel 10 with three horizontally disposed sub-pixels. Each sub-pixel 100 is able to display in two tones. Accordingly, a single pixel 10 is able to display eight colors.

Moreover, the display device 1 is provided with a gate driver 20 and a source driver 30. The gate driver 20 drives a refresh line Lrfrsh, a sample line Lsmpl, control line Lg2 and Lg4 and a gate line Lgate. The source driver 30 drives source lines Lsrc. As a result of driving these lines by the gate driver 20 and the source driver 30, the display device 1 displays images.

Figure 2:
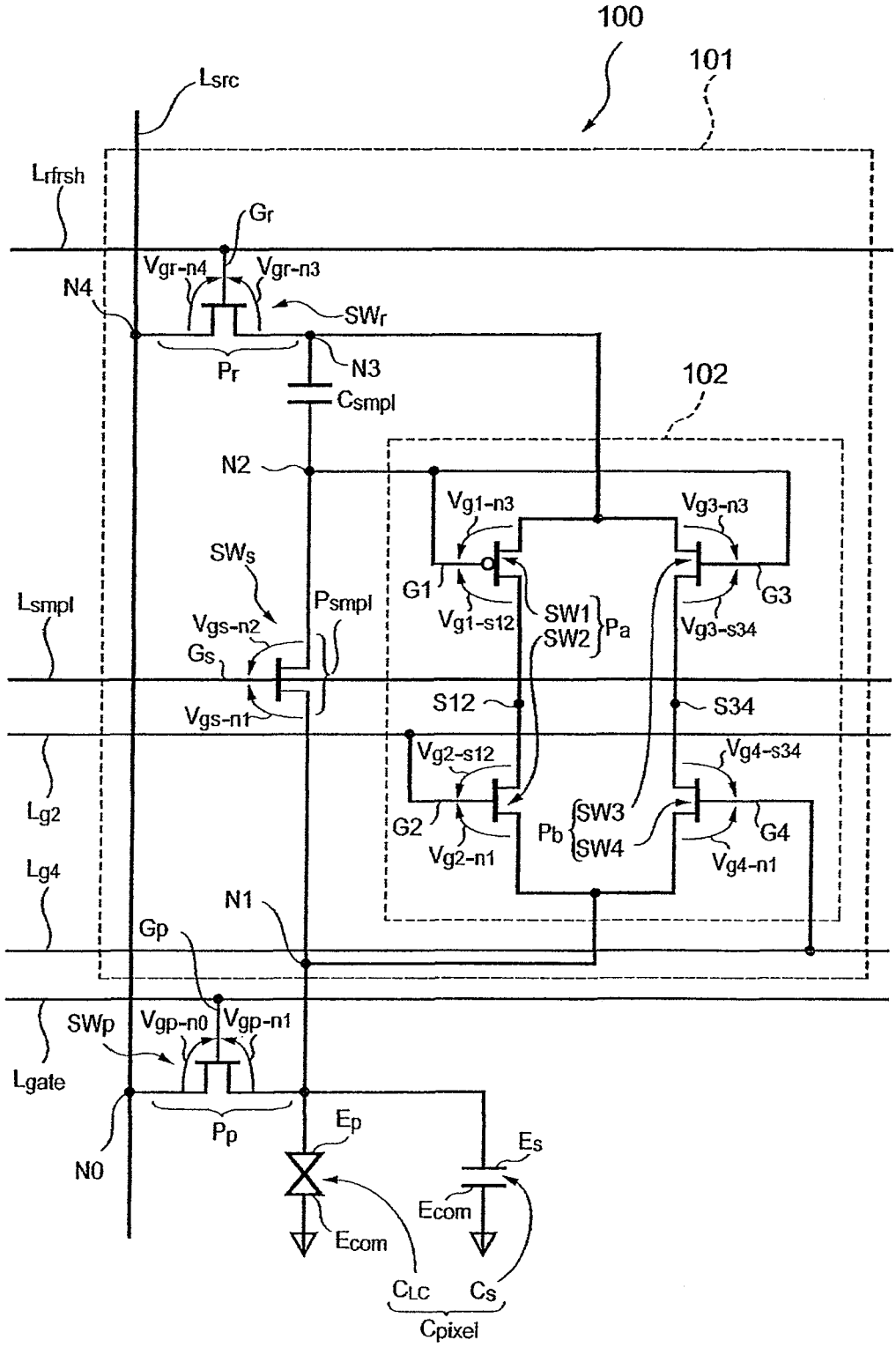
FIG. 2 is a magnified detailed illustration of one sub-pixel 100 as shown in FIG. 1.

FIG. 2 is a magnified detailed illustration of a single sub-pixel 100 as shown in FIG. 1.

The sub-pixel 100 has a sub-pixel capacitance Cpixel that comprises a liquid crystal capacitance CLC and a storage capacitance Cs. The liquid crystal capacitance CLC could comprise but be not limited to a sub-pixel electrode Ep and a common electrode Ecom. The storage capacitance Cs comprises a storage capacitance electrode Es and a common electrode Ecom. The sub-pixel electrode Ep is connected to the storage capacitance electrode Es. Moreover, the sub-pixel 100 is provided with a sub-pixel switch SWp. In this embodiment, the sub-pixel switch SWp comprises an n-type TFT (Thin Film Transistor) but may use other switching element.

A gate terminal Gp of the sub-pixel switch SWp is connected to the gate line Lgate. A primary current path Pp of the sub-pixel switch has its one end connected to the source line Lsrc and the other terminal connected to the sub-pixel electrode Ep. The display device 1 employs the reverse driving scheme in which the polarity of the voltage to be applied to the sub-pixel capacitance Cpixel is reversed. In this embodiment, a constant voltage is applied to the common electrode Ecom and a voltage that varies in voltage level is applied to the sub-pixel electrode Ep (and the storage capacitance electrode Es), thereby achieving the reverse driving scheme.

Furthermore, the sub-pixel 100 is provided with a refresh circuit 101. The refresh circuit 101 has a sample capacitor Csmpl for temporarily memorizing a voltage written on the sub-pixel electrode Ep (node N1). Moreover, the refresh circuit 101 has a sample switch SWs for sampling a voltage written on the sub-pixel electrode Ep (node N1). Although an n-type TFT is used to form the sample switch SWs in this particular embodiment, it is also possible to use other switch. A gate terminal Gs of the sample switch SWs is connected to the sample line Lsmpl. The primary current path of the sample switch SWs has one terminal connected to the sub-pixel electrode Ep and the other terminal connected to the sample capacitor Csmpl. The refresh circuit has a voltage selection circuit 102. The voltage selection circuit 102 is provided for the purpose of inverting the polarity of the voltage written on the sub-pixel electrode Ep (node N1). The voltage selection circuit 102 comprises four switches SW1, SW2, SW3 and SW4. In this embodiment, the switch S1 is a p-type TFT, while the remaining three switches SW2, SW3 and SW4 are n-type TFTs. The switch SW1 is connected in series with the switch SW2 and the series connected SW1 and SW2 form one current path Pa. Similarly, the SW3 is connected in series with the SW4 and the series connected SW3 and SW4 form another current path Pb. The series connected switches SW1-SW2 and the series connected switches SW3-SW4 are connected in parallel with each other. Moreover, the gate terminals G1 and G3 of the switches SW1 and SW3 are connected to the sample capacitor Csmpl. On the other hand, the gate terminals G2 and G4 of the switches SW2 and SW4 are connected respectively to the control lines Lg2 and Lg4.

The refresh circuit 101 is provided with a refresh switch SWr. Although an n-type TFT is used for the refresh switch SWr in this embodiment, it is also possible to use other switch. A gate terminal Gr of the refresh switch SWr is connected to the refresh line Lrfrsh. A principal current path Pr of the refresh switch SWr has one terminal connected to the source line Lsrc and the other terminal connected to the sample capacitor Csmpl and the voltage selection circuit 102. The voltage selection circuit 102 receives plural refresh voltages from the source line Lsrc through the refresh switch SWr and selects the refresh voltage to be written on the sub-pixel electrode Ep for outputting the selected refresh voltage to the sub-pixel electrode Ep. In this manner, the voltage selection circuit 102 is able to invert the polarity of the voltage written on the sub-pixel electrode Ep (node N1). The manner how to invert the polarity of the voltage written on the sub-pixel electrode Ep (node N1) by the voltage selection circuit 102 will be described in detail hereinafter.

All sub-pixels 100 have the construction as described hereinabove. The seven switches SWp, SWs, SWr, SW1, SW2, SW3 and SW4 are formed by using n-type TFTs except the SW1 that is formed by a p-type TFT. It is to be noted, however, that modifications may be made if necessary to use n-type TFTs or p-type TFTs for each of these seven switches.

The display device 1 having the above construction is able to carry out inverted driving at lower power consumption than the conventional device. The reason will be described hereunder along with the operation of the refresh circuit 101 for the sub-pixel 100.

Figure 3:
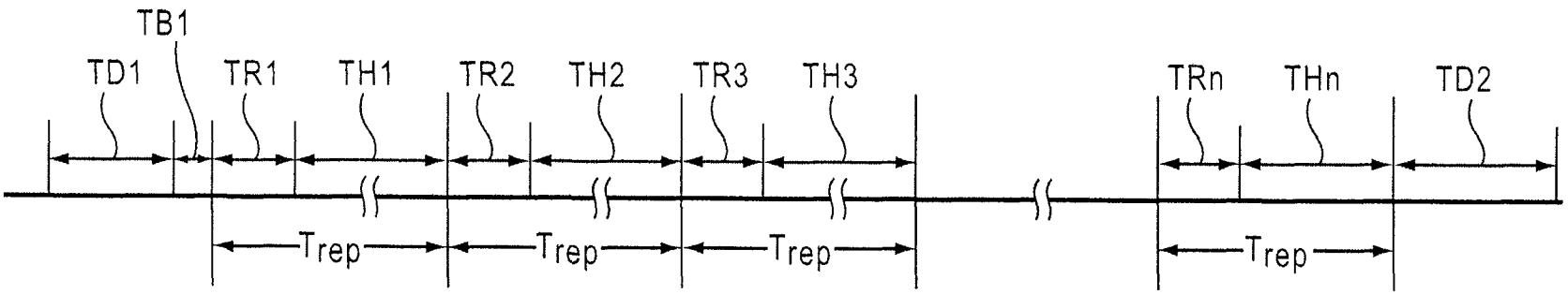
FIG. 3 is a simplified illustration of the contents of the refresh operation that the display device 1 performs.

FIG. 3 is a simplified diagram to show the refresh operation of the display device 1.

Prior to the refresh operation, the display device 1 first writes necessary voltages on the sub-pixel electrodes Ep of all sub-pixels 100. In order to write data voltages on the sub-pixel electrodes Ep of all sub-pixels 100, it is possible to use, for example, the normal line scanning method. Subsequent to writing the data voltages on the sub-pixel electrodes Ep of all pub-pixels 100, the display device 1 performs the refresh operation. Concretely, the display device 1 performs the refresh operation in refresh periods TR1, TR2, . . . , TRn that are repeated at a constant period Trep. The display device 1 inverts the polarity of the voltage written in the data writing period TD1 on the sub-pixel electrodes Ep of all sub-pixels 100 during the first refresh period TR1. However, in case of no need to reverse the polarity as described hereinafter, the voltage written in the data-writing period TD1 is held as it is. At the completion of the refresh period TR1, a hold period TH1 starts.

In the hold period TH1, the voltage that is reversed in polarity during the refresh period TR1 is held. Although the display device holds the polarity inverted voltage during the hold period TH1, the polarity of the voltage is inverted again in the next subsequent refresh period TR2 and the polarity inverted voltage is held during the hold period TH2. Subsequently, the refresh periods and the hold periods are alternately repeated until reaching the next data-writing period TD2.

Now, concrete operations in the refresh period and the hold period will be described hereunder.

Figure 4:
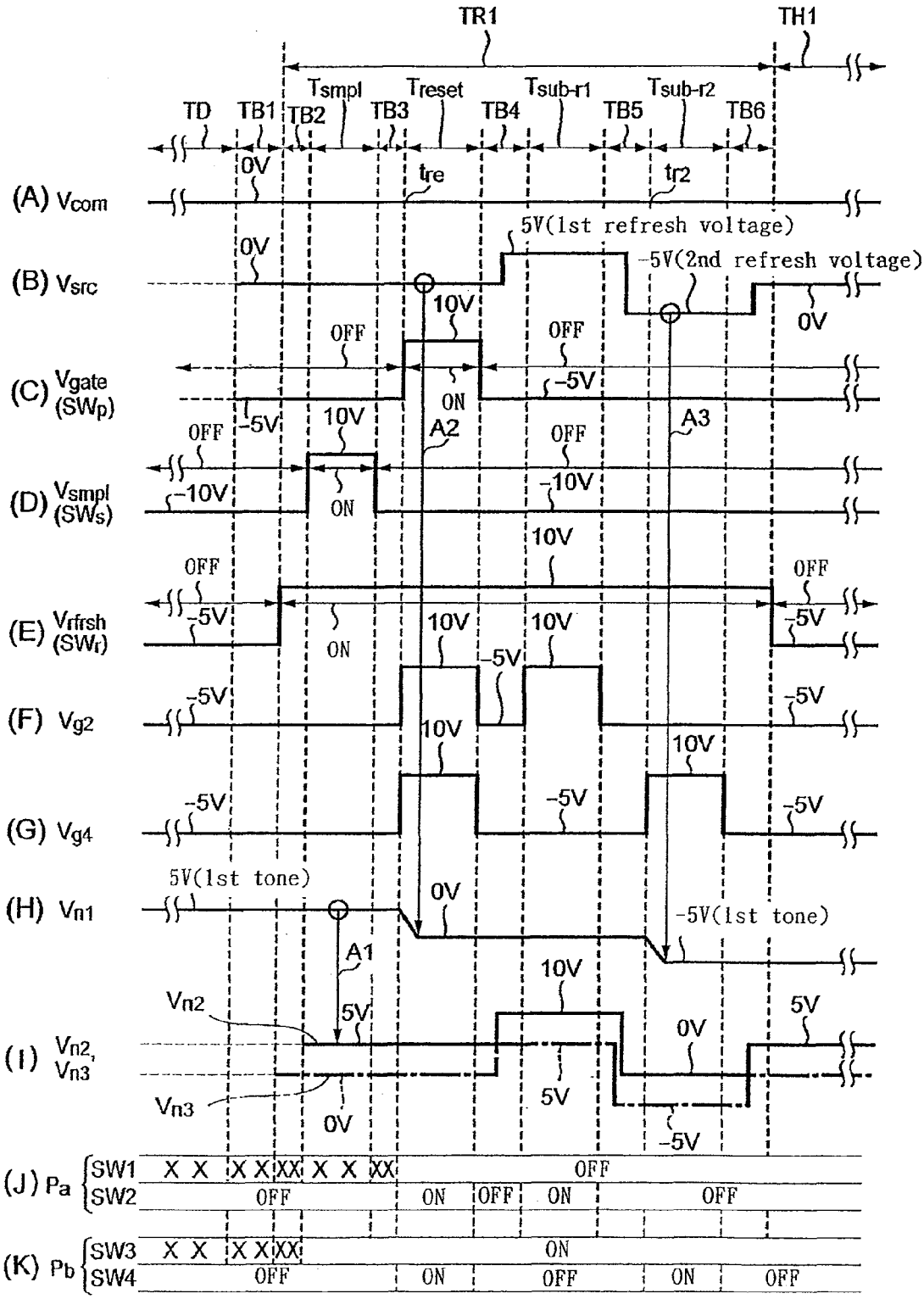
FIG. 4 shows a timing chart of the display device 1.

FIG. 4 shows a timing chart of the display device 1.

Shown in FIG. 4 are voltage waveforms (A) through (I) in the time frame from the data-writing period TD1 to the hold period TH1. Also shown below the voltage waveform (I) are a state chart (J) of the switches SW1 and SW2 in the first current path Pa (i.e., whether the switches SW1 and SW2 are ON or OFF) and a state chart (K) of the switches SW3 and SW4 in the second current path Pb (i.e., whether the switches SW3 and SW4 are ON or OFF).

Although a common potential Vcom equal to 0V is applied to the common electrode Ecom in this embodiment (see the waveform (A)), the common voltage Ecom may be any voltage other than 0V. It is to be noted in this embodiment that potentials on each electrode, each line and each node are defined with reference to the potential 0V that is applied to the common electrode Ecom. Accordingly, these potentials are expressed as voltage differences from the 0V potential applied to the common electrode Ecom.

Firstly, a data voltage is written on the sub-pixel electrodes Ep from the source line Lsrc through the sub-pixel switch SWp in the data-writing period TD1. Each sub-pixel 100 is designed to provide a two-tone display and the written data voltage differs depending on which one of the two tone displays is displayed by each sub-pixel 100. Although the two-tone displays (i.e., a first tone and a second tone displays) are provided by setting the voltage across the sub-pixel capacitance CLC to 5V and 0V, it is possible to choose voltages to be applied across the sub-pixel capacitance CLC any values other than 5V and 0V. Upon applying 5V across the sub-pixel capacitance CLC, the sub-pixel 100 provides the first tone display. On the other hand, the second tone display is provided by the sub-pixel 100 upon applying 0V across the sub-pixel capacitance CLC. Since the common voltage Vcom is 0V, in order to write 0V across the sub-pixel capacitance CLC (i.e., for causing the sub-pixel 100 to provide the second tone display), 0V is written on the sub-pixel electrode Ep. On the other hand, in order to apply 5V voltage across the sub-pixel capacitance CLC (i.e., for causing the sub-pixel 100 to provide the first tone display), it is possible to write either 5V or −5V on the sub-pixel electrode Ep. Since the display device 1 employs the inverted driving scheme herein, 5V and −5V are alternately written on the sub-pixel electrode Ep when applying 5V across the sub-pixel capacitance CLC. Accordingly, there are cases to write 0V, 5V or −5V on the sub-pixel electrode Ep, a description will be continued in FIG. 4 on assuming that 5V is written. Upon writing 5V on the sub-pixel electrode Ep, the sub-pixel 100 provides the first tone display and the voltage Vn1 on the node N1 becomes 5V (see the waveform (H)). After writing 5V on the sub-pixel electrode Ep, the sub-pixel switch SWp is turned OFF.

The sample switch SWs is maintained OFF during the data-writing period TD1. In order to turn OFF the sample switch SWs, it is necessary to set voltage Vgs-n1 on the gate terminal Gs of the sample switch SW2 for the node N1 and voltage Vgs-n2 on the gate terminal Gs of the sample switch SWs for the node N2 sufficiently lower than the threshold voltage Vth of the sample switch SWs. In this embodiment, it is assumed that the threshold voltage Vth for an n-type switch is approximately 1V, while that of a p-type switch is approximately −1V. Since the sample switch SWs uses an n-type switch, its threshold voltage Vth is approximately 1V. Accordingly, the voltages Vgs-n1 and Vgs-n2 must be sufficiently lower than the threshold voltage Vth (≈1V). In order to achieve this, −10V sample line voltage Vsmpl is applied to the sample line Lsmpl during the data-writing period TD1 (see the waveform (D)). This holds the voltage Vgs-n1 to −15V, thereby sufficiently lower than the threshold voltage Vth (≈1V). On the other hand, the voltage Vgs-n2 depends on the voltage Vn2 on the node N2. However, since the voltage Vn2 is indefinite during the data-writing period TD1, the voltage Vgs-n2 is also indefinite. However, in consideration of possible voltages that the voltage Vn2 may take in this embodiment (the waveform (I) in FIG. 4 and waveforms (I) in both FIG. 5 and FIG. 6 that will be described hereinafter), if the sample voltage Vsmpl is −10V, the voltage Vgs-n2 is believed to be sufficiently lower than the threshold voltage Vth (≈1V) in the data writing period TD1. Accordingly, the sample line voltage Vsmpl is set to −10V (see the waveform (D)) for making both of the Vgs-n1 and Vgs-n2 sufficiently lower than the threshold voltage Vth (≈1V), the sample switch SWs is held OFF during the data writing period TD1. The state (ON or OFF) of the sample switch SWs is also shown in the waveform (D) together with the sample line voltage Vsmpl.

The refresh switch SWr is also maintained OFF during the data-writing period TD1. In order to turn OFF the refresh switch SWr, the voltage Bgr-n4 on the gate terminal Gr of the refresh switch SWr for the node N4 and the voltage Vgr-n3 on the gate terminal Gr of the refresh switch SWr for the node N3 need to be sufficiently lower than the threshold voltage Vth (≈1V) of the refresh switch SWr. In order to achieve this, −5V refresh line voltage Vrfrsh is applied to the refresh line Lrfrsh during the data-writing period TD1 (see the waveform (E)). The voltage Vgr-n3 depends on the voltage Vn3 on the node N3. However, since the voltage Vn3 is indefinite during the data-writing period TD1, the voltage Vgr-n3 is also indefinite. However, in consideration of possible values that the voltage Vn3 may take in this embodiment (see the single chain line in the waveform (I) in FIG. 4 and also single chain lines in the waveforms (I) in both FIG. 5 and FIG. 6 to be described hereinafter), if the refresh line voltage Vrfrsh is −5V, the voltage Vgr-n3 is sufficiently lower than the threshold voltage Vth (≈1V). On the other hand, although the voltage Vgr-n4 depends on the voltage Vn4 on the node N4, the voltage Vn4 is also indefinite during the data-writing period TD1 and the voltage Vgr-n4 is also indefinite. However, in consideration of possible values that the voltage Vn4 may take in this embodiment (see waveform (B) in FIG. 4 and also waveforms (B) in FIG. 5 and FIG. 6 to be described hereinafter), if the refresh line voltage Vrfrsh is −5V, the voltage Vgr-n4 remains sufficiently lower than the threshold voltage Vth (≈1V). Accordingly, by setting the refresh line voltage Vrfrsh to −5V (see waveform (E)), both voltages Vgr-n3 and Vgr-n4 are maintained sufficiently lower than the threshold voltage Vth (≈1V), thus the refresh switch SWr is kept OFF during the data writing period TD1. Whether the refresh switch SWr is ON or OFF is shown in the waveform (E) together with the refresh line voltage Vrfrsh.

The switches SW2 and SW4 in the voltage selection circuit 102 are also maintained OFF during the data-writing period TD1. In order to turn OFF the switch SW2, the voltage Vg2-n1 on the gate terminal G2 of the switch SW2 for the node N1 and the voltage Vg2-s12 on the gate terminal of the switch SW2 for the node S12 must be sufficiently lower than the threshold voltage Vth (≈1V) of the switch SW2. Similarly, in order to turn OFF the switch SW4, the voltage Vg4-n1 on the gate terminal G4 of the switch SW4 for the node N1 and the voltage Vg4-s34 on the gate terminal G4 of the switch SW4 for the node S34 must be sufficiently lower than the threshold voltage Vth (≈1V) of the switch SW4. For achieving this, −5V control line voltage Vg2 and Vg4 are applied respectively to the control lines Lg2 and Lg4 during the data writing period TD1 (see waveforms (F) and (G)). Since the voltage Vn1 on the node N1 is 5V (see waveform (H)), the voltages Vg2-n1 and Vg4-ni are held −10V, which are sufficiently lower than the threshold voltage Vth (≈1V). On the other hand, the voltages Vg2-s12 and Vg4-s34 depend respectively on the voltages Vs12 and Vs34 on the nodes S12 and S34. However, these voltages Vs12 and Vs34 are indefinite in the data-writing period TD1, and thus the voltages Vg2-s12 and Vg4-s34 are also indefinite. However, in consideration of possible values that the voltages Vs12 and Vs34 may take in this embodiment, if the control line voltages Vg2 and Vg4 are −5V, the voltages Vg2-s12 and Vg4-s34 are sufficiently lower than the threshold voltage Vth (≈1V).

Accordingly, both of the voltages Vg2-n1 and Vg2-s12 of the switch SW2 are sufficiently lower than the threshold voltage Vth. Similarly, the voltages Vg4-n1 and Vg4-s34 of the switch SW4 are also sufficiently lower than the threshold voltage Vth. As a result, the switches SW2 and SW4 are held OFF during the data-writing period TD1 (see state diagrams (J) and (K)).

After termination of the data-writing period TD1, there is a blank period TB1.

During the blank period TB1, 0V source line voltage Vsrc is applied to the source line Lsrc (see waveform (B)). It is to be noted that if 0V source line voltage Vsrc is applied to the sub-pixel electrode Ep during the sub-pixel electrode Ep, a voltage different from 5V that is written in the data-writing period TD1 is written, thereby disabling the sub-pixel 1000 to display a correct image. In order to avoid this, the sub-pixel switch SWp remains OFF during the blank period TB1. In order to turn OFF the sub-pixel switch SWp, the voltage Vgp-n0 on the gate terminal Gp of the sub-pixel switch SWp for the node N0 and the voltage Vgp-n1 on the gate terminal Gp of the sub-pixel switch SWp for the node N1 must be sufficiently lower than the threshold voltage Vth (≈1V) of the sub-pixel switch SWp. For achieving this, −5V gate line voltage Vgate is applied to the gate line Lgate during the blank period TB1 (see waveform (C)). This holds the voltage Vgp-n0 equal to −10V, thereby holding the voltage Vgp-n1 to −10V. Accordingly, the voltages Vgp-n0 and Vgp-n1 are held sufficiently lower than the threshold voltage Vth (≈1V), thereby holding the sub-pixel switch SWp OFF. Whether the sub-pixel switch SWp is ON or OFF is shown in the waveform (C) together with the gate line voltage Vgate. Since the sub-pixel switch SWp is OFF during the blank period TB1, it is possible to prevent 0V source line voltage Vsrc from being written on the sub-pixel electrode Ep during the blank period TB1 (see waveform (B)).

On the other hand, since the sample line voltage Vsmpl remains −10V during the blank period TB1 and the refresh line voltage Vrfrsh and the control line voltage Vg2 and Vg4 remain −5V, the switches SWs, SWr, SW2 and SW4 remain OFF.

After termination of the blank period TB1, the refresh period TR1 starts.

At the start of the refresh period TR1, the refresh line voltage Vrfrsh first changes from −5V to 10V (see waveform (E)). The refresh voltage Vrfrsh is 10V during the refresh period TR1. On the other hand, the source line voltage Vsrc changes sequentially in the order of 0V, 5V, −5 v and 0V (see waveform (B)). Accordingly, if the refresh line voltage Vrfrsh is 10V, the voltage Vgr-n4 for the refresh switch SWr is 5V or higher during the refresh period TR1 and thus the voltage Vgr-n4 is sufficiently larger than the threshold voltage Vth (≈1V). In other words, the refresh switch SWr remains ON during the refresh period TR1 (see waveform (E)). As a result, the voltage Vn3 on the node N3 is the same as the source line voltage Vsrc at least during the refresh period TR1. The waveform of the voltage Vn3 on the node N3 is shown by the single chain line in the waveform (I). With reference to the blank period TB2 during the refresh period TR1, since the source line voltage Vsrc is 0V (see waveform (B)), the voltage Vn3 on the node N3 becomes 0V (see waveform (I)). The blank period TB2 is included in the refresh period TR1 and the sample period Tsmpl starts after the blank period TB2.

When the sample period Tsmpl starts, the sample line voltage Vsmpl first changes from −10V to 10V (see waveform (D)). The sample line voltage Vsmpl is WV during the sample period Tsmpl. The voltage Vn1 on the node N1 is 5V during the sample period Tsmpl (see waveform (H)). Accordingly, the voltage Vgs-n1 of the sample switch SWs is 5V. In other words, since the voltage is sufficiently larger than the threshold voltage Vth (≈1V), the sample switch SWs remains ON (see waveform (D). If the sample switch SWs is ON, the nodes N1 and N2 are electrically connected to each other. Since the sub-pixel capacitance Cpixel connected to the node N1 is larger than the capacitance of the sample capacitor Csmpl connected to the node N2 by several hundreds times, electrical connection of the nodes N1 and N2 makes the voltage V2 on the node N2 substantially equal to the voltage Vn1 on the node N1. Since the voltage Vn1 on the node N1 is 5V, the voltage Vn2 on the node N2 is also 5V (see the solid line in waveform (I)). This condition is symbolically shown by an arrow A1 between waveforms (H) and (I). In the above manner, the voltage 5V written on the node N1 (the sub-pixel electrode Bp) during the data writing period TD1 is memorized in the sample capacitor Csmpl. The fact of memorizing the 5V voltage in the sample capacitor Csmpl on the node N2 (see the solid line in waveform (I)) means that the voltage written on the node N1 in the data writing period TD1 is 5V.

It is to be noted that since the voltage Vn2 on the node N2 during the sample period Tsmpl is 5V (see the solid line in waveform (I)), the voltage on the gate terminals G1 and G2 of the switches SW1 and SW2 in the voltage selection circuit 102 is also 5V. On the other hand, the voltage Vn3 on the node N3 is 0V during the sample period Tsmpl (see the single chain line in waveform (I)). As a result, the voltage Vg3-n3 on the gate terminal 63 of the switch SW3 for the node N3 is 5V. Since the threshold voltage of the switch SW3 is 5V, the switch SW3 is ON (see the state diagram (K)). Although the switch SW3 is ON, the switches SW2 and SW4 remain OFF (see the state diagrams (J) and (K)), there is no possibility that the source line voltage Vsrc is applied to the node N1 through the voltage selection circuit 102. At the end of the sample period Tsmpl, a reset period Treset is initiated subsequent to a blank period TB3.

In the reset period Treset, 0V voltage is written on the junction S12 of the Switches SW1 and SW2 and also 0V is written on the junction S34 of the switches SW3 and SW4. For this end, the gate line voltage Vgate changes from −5V to 10V at the starting point (tre) of the reset period Treset and the 10V is held during the reset period Treset (see waveform (C)). Since the source line voltage Vsrc is 0V during the reset period (see waveform (B)), the voltage Vgp-n0 of the sub-pixel switch SWp is 10V. Accordingly, the sub-switch SWp is ON (see waveform (C)). If the sub-pixel switch SWp is ON, the source line voltage Vsrc (0V) is written on the node N1 and the voltage Vn1 changes from 5V to 0V (see waveform (H)). This is illustrated shown by an arrow A2 between the waveforms (B) and (H). The control line voltages Vg2 and Vg4 of the switches SW2 and SW4 also change from −5V to 10V at the starting point (tre) of the reset period Treset, and 10V is held during the reset period Treset (see waveforms (F) and (G)). The voltage Vn1 on the node N1 becomes 0V in the reset period Treset (see waveform (H)), the voltages Vg2-n1 and Vg4-n1 of the switches SW2 and SW4 become 10V. Accordingly, the voltages Vg2-n1 and Vg4-n1 are sufficiently larger than the threshold voltage Vth (≈1V), thereby turning ON the switches SW2 and SW4 (see state diagrams (J) and (K)). Consequently, the source line voltage Vsrc (0V) is written on the junction of the switches SW1 and SW2 and it is also written on the junction S34 of the switches SW3 and SW4. The reason of writing 0V voltage on the junctions 22 and S34 in the reset period Treset will be described somewhere hereinafter. The voltage Vn3 on the node N3 is also 0V during the reset period Treset (see a single dotted line in waveform (I)). Accordingly, voltages on the junctions S12 and S34 as well as on the node N3 are all 0V during the reset period Treset. On the other hand, the voltage Vn2 on the node N2 is 5V during the reset period Treset (see the solid line in waveform (I)). Accordingly, since the voltages Vg1-s12 and Vg1-n3 are all 5V, the switch SW1 is OFF (see state diagram (J)). It should be noted that the switch SW3 remains ON (see the state diagram (K)).

Upon termination of the reset period Treset, a first sub-refresh period Tsub-r1 and a second sub-refresh period Tsub-r2 sequentially start with a blank period therebetween. It is to be noted here that the source line voltage Vsrc has two refresh voltages. Concretely, the source line voltage Vsrc takes a first refresh voltage (5V) during the first sub-refresh period Tsub-r1, while takes a second refresh voltage (−5V) during the second sub-refresh period Tsub-r2 (see waveform (B)). Since the refresh switch SWr is ON during the refresh period TR1, the voltage selection circuit 102 receives 5V first refresh voltage and −5V second refresh voltage respectively in the first sub-refresh period Tsub-r1 and the second sub-refresh period Tsub-r2 from the source line Lsrc through the refresh switch SWr. The voltage selection circuit 102 selects either one of the received first and second refresh voltages 5V and −5V that is necessary for inverting the polarity of the voltage written on the node N1 (sub-pixel electrode Ep) in the data writing period and applies it onto the node N1. In FIG. 4, since voltage 5V is written on the node N1 in the data-writing period TD1 (see waveform (H)), the voltage selection circuit 102 needs to select the second refresh voltage (−5V) for application of the voltage onto the node N1 in order to invert the polarity. In order to achieve selection of such voltage, the refresh circuit 101 operates as follows upon termination of the reset period Treset.

There is a blank period TB4 after termination of the reset period Tseset and before starting the first sub-refresh period Tsub-r1. Since the control line voltages Vg2 and Vg4 are −5V during the blank period TB4 (see waveforms (F) and (G)), the switches SW2 and SW4 in the voltage selection circuit 102 are OFF (see state diagrams (J) and (K)). The source line voltage Vsrc changes from 0V to the first refresh voltage (5V) in the blank period TB4 (see waveform (B)). Since the refresh switch SWr is ON (see waveform (E)), the first refresh voltage (5V) is applied to the voltage selection circuit 102. When the source line voltage Vsrc changes to 5V, the voltage Vn3 on the node N3 also changes from 0V to 5V (see the single chain line in waveform (I)). Since the node N3 is capacitively coupled to the node N2 through the sample capacitor Csmpl, when the voltage Vn3 on the node N3 changes from 0 to 5V, the voltage Vn2 on the node N2 changes from 5V to 10V (see the solid line in waveform (I)). If the voltage Vn3 on the node N3 reaches 5V in the blank period TB4, the voltage on the node N2 becomes 10V, thereby enabling the switch SW1 in the voltage selection circuit 102 to remain OFF (see the state diagram (J)). On the other hand, the switch SW3 remains ON (see the state diagram (K)).

After termination of the blank period TB4, the first sub-refresh period Tsub-r1 starts. The control line voltage Vg2 changes from −5V to 10V and 10V is maintained during the first sub-refresh period Tsub-r1 (see waveform (F)). Accordingly, the switch SW2 turns ON (see the state diagram (J)). When the switch SW2 turns ON, since the switch SW1 remains OFF, the first refresh voltage (5V) received by the voltage selection circuit 102 is not outputted to the node N1 through the first current path Pa. Moreover, since the control line voltage Vg4 remains −5V during the first sub-refresh period Tsub-r1 (see waveform (G)), the switch SW4 remains OFF (see the state diagram (K)). Accordingly, the first refresh voltage (5V) received by the voltage selection circuit 102 is not outputted to the node N1 through the second current path Pb, i.e., the voltage selection circuit 102 does not output the received first refresh voltage (5V) to the node N1. As a result, the voltage on the node N1 remains 0V.

There is a blank period TB5 after termination of the first sub-refresh period Tsub-r1 and before starting the second sub-refresh period Tsub-r2. The control line voltage Vg2 returns to −5V during the blank period TB5 (see waveform (F)), thereby returning the switch SW2 in the voltage selection circuit 102 to OFF (see the state diagram (J)). On the other hand, the source line voltage Vsrc changes from the first refresh voltage (5V) to the second refresh voltage (−5V) during the blank period TB5. Since the refresh switch SWr is ON (see waveform (E)), the second refresh voltage (−5V) is applied to the voltage selection circuit 102. When the source line voltage Vsrc changes from 5V to −5V, the voltage Vn3 on the node N3 also changes from 5V to −5V (see the single chain line in waveform (I)). Since the node N3 is capacitively coupled to the node N2 through the sample capacitor Csmpl, when the voltage Vn3 on the node N3 changes from 5V to −5V, to voltage Vn2 on the node N2 changes from 10V to 0V (see the solid line in waveform (I)). Although the voltage Vn3 on the node N3 becomes −5V during the blank period TB5, the voltage on the node N2 also becomes 0V and the switch SW1 in the voltage selection circuit 102 remains OFF (see state diagram (J)). On the other hand, the switch SW3 remains ON (see the state diagram (K)).

After termination of the blank period TB5, the second sub-refresh period Tsub-r2 starts. During the second sub-refresh period Tsub-r2, the control line voltage Vg2 remains −5V (see waveform (F)) and the switch SW2 remains OFF (see the state diagram (J)). Accordingly, the second refresh voltage=5V) received by the voltage selection circuit 102 is not outputted to the node N1 through the first current path Pa. However, it is to be noted that the control line voltage Vg4 changes from −5V to 10V at the start (tr2) of the second sub-refresh period Tsub-r2 (see waveform (G)). Since the voltage Vn1 on the node N1 is 0V at the start time (tr2) of the second sub-refresh period Tsub-r2 (see waveform (H)), the voltage Vg4-n1 for the switch SW4 becomes 10V at the instance when the control line voltage Vg4 becomes 10V. Accordingly, the voltage Vg4-n1 is sufficiently larger than the threshold voltage Vth (≈1V) and the switch SW4 changes to ON (see the state diagram (K)). Since the switch SW4 remains ON, as soon as the switch SW4 changes to ON, the second refresh voltage (−5V) received by the voltage selection circuit 102 is outputted to the node N1 through the second current path Pb. That is, since the voltage selection circuit 102 outputs the received second refresh voltage (−5V) to the node N1, −5V voltage is written on the node N1. This is symbolically shown by an arrow A3 between waveforms (B) and (H).

After termination of the second sub-refresh period Tsub-r2, there is a blank period TB6. During the blank period TB6, the source line voltage Vsrc changes from −5V to 0V (see waveform (B)), then the voltage Vn3 on the node N3 changes correspondingly from −5V to 0V (see the single chain line in waveform (I)). On the other hand, the voltage Vn2 on the node N2 changes from 0V to 5V (see the solid line in waveform (I)). Subsequently, the refresh line voltage Vrfrsh on the refresh line Lrfrsh changes from 10V to −5V, thereby turning OFF the refresh switch SWr (see waveform (E)). This leads to termination of the refresh period TR1.

As described hereinabove, in FIG. 4, the voltage Vn1 (=5V) written on the node N1 in the data writing period TD1 is memorized on the sample capacitor Csmpl during the sample period Tsmpl. And before starting the first sub-refresh period Tsub-r1, the switch SW1 in the first current path Pa turns OFF (see the state diagram (3)) and the switch SW3 in the second current path Pb turns ON (see the state diagram (K)). Accordingly, by maintaining the switch SW4 in the OFF state during the first sub-refresh period Tsub-r1, the first refresh voltage (5V) is not written on the node N1. However, by maintaining the switch SW4 in the ON state during the second sub-refresh period Tsub-r2, the second refresh voltage (−5V) is written on the node N1. In this way, the voltage 5V that is written on the node N1 during the data-writing period TD1 is inverted to the voltage −5V. Among the entire sub-pixels 100, the sub-pixels 100 on which the positive polarity voltage 5V is written are controlled to simultaneously write the second refresh voltage (−5V) in accordance with the timing chart in FIG. 4.

Now, the reason why 0V voltage is written on the junctions S12 and S34 in the reset period Treset will be described hereunder.

As described hereinabove, it is necessary to turn OFF the switch SW1 and to turn ON the switch SW3 in order to invert 5V written in the data-writing period TD1 to −5V in this embodiment (see the state diagram (J) and (K)). ON/OFF state of the switch SW1 depends on the voltage on the junction S12, while ON/OFF state of the switch SW3 depends on the voltage on the junction S34. Accordingly, if the voltages on the junctions S12 and S34 are indefinite, it is possible that the switches SW1 and SW3 do not turn ON or OFF in accordance with the timing chart as shown in FIG. 4. As a result, in this embodiment, the reset period Treset is provided to write 0V on the junctions S12 and S34. This determines the voltages on the junctions S12 and S34, thereby ensuring the switches SW1 and SW3 to turn ON/OFF in accordance with the timing chart as shown in FIG. 4. Accordingly, the necessary refresh voltage or either one of the first and second refresh voltages (5V and −5V) is written on the node N1. It is to be noted that, if the voltage selection circuit 102 operates correctly, the voltages on the junctions S12 and S34 may be determined in other methods.

After termination of the refresh period TR1, a hold period TH1 starts.

The source line voltage Vsrc remains constant during the hold period TH1 and the gate line voltage Vgate, the refresh line voltage Vrfrsh, and the control line voltage Vg2 and Vg4 are −5V constant, while the sample line voltage Vsmpl is −10V constant. This holds the switches SWp, SWs, SWr, SW2 and SW4 within the sub-pixel 100 in the OFF state. Accordingly, −5V on the node N1 (see waveform (H)), is held during the hold period TH1. The fact that the node N1 is held −5V means that the sub-pixel 100 is displayed in the first tone. Accordingly, the sub-pixel 100 continues to display in the first tone throughout the time from the data-writing period TD1 to the hold period TH1. It is to be noted in FIG. 4 that the voltage Vn1 on the node N1 is 0V from the reset period Treset to the blank period TB5 (see waveform (H)). Accordingly, the sub-pixel 100 displays in the second tone rather than the first tone during the time from the reset period Treset to the blank period TB5. However, since the time duration from the reset period Treset to the blank period TB5 is very short, the viewer of the display device 1 is unable to recognize that the sub-pixel 100 displays in the second tone during the time from the reset period Treset to the blank period TB5. Consequently, the viewer recognizes as if the sub-pixel 100 continuously displays in the first tone for the entire time duration from the data-writing period TD1 to the hold period TH1. Accordingly, attention should be paid that the voltage Vn1 on the node N1 being 0V in the time from the reset period Trset to the blank period TB5 provides no affect to the viewer in recognizing the first tone. It is to be noted that the reset period Treset may be abbreviated if the display device 1 is able to correctly display images.

In order to causes the sub-pixel 100 to display in the first tone in FIG. 4, 5V is applied on the node N1 in the data-writing period TD1. However, there are cases of applying −5V on the node N1 in the data-writing period TD1 in order to cause the sub-pixel to display in the first tone. A refresh operation in case of writing −5V on the node N1 in the data writing period TD1 will be described hereunder.

Figure 5:
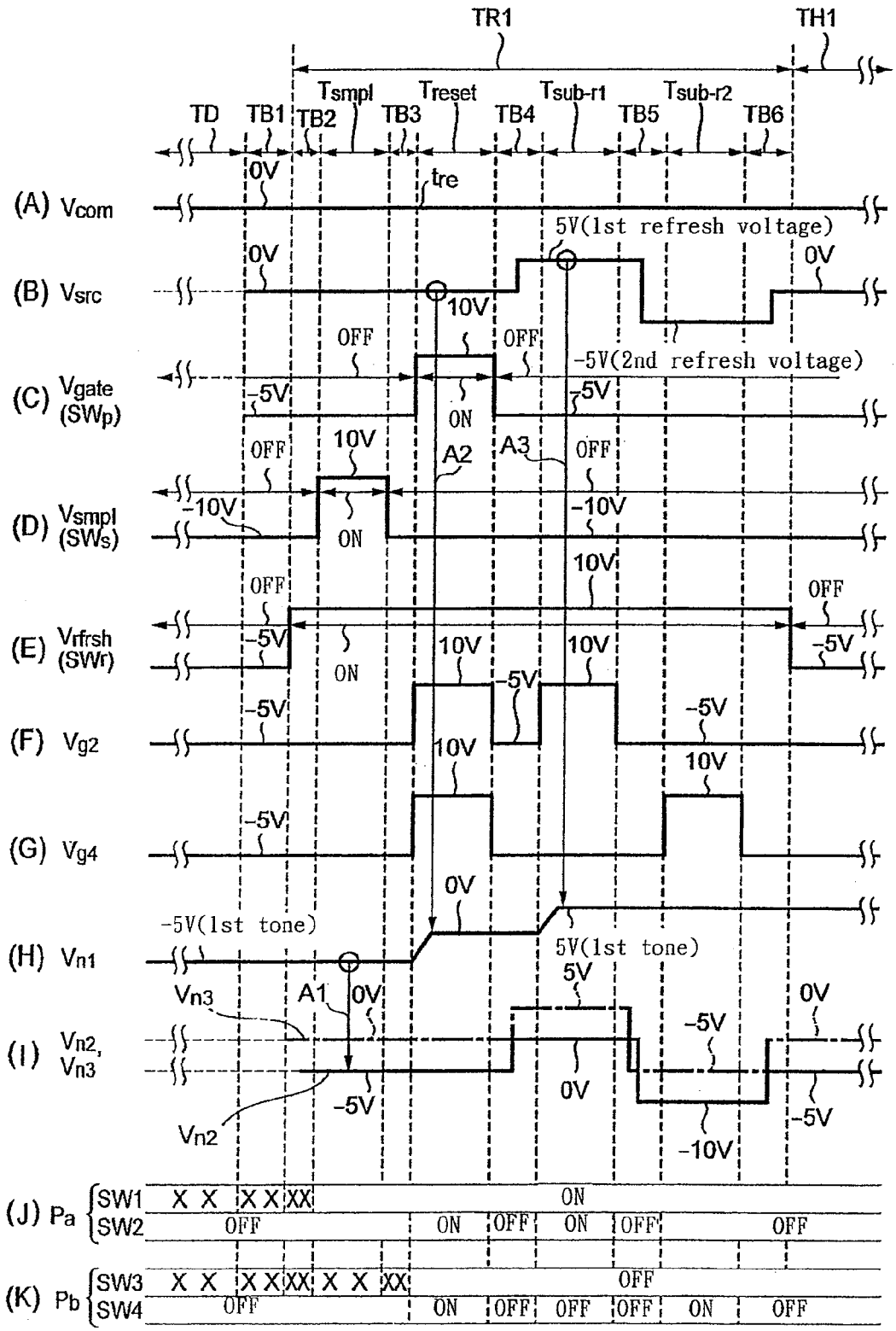
FIG. 5 shows a timing chart in the sub-pixel 100 in which −5V is written in the data writing period TD1.

FIG. 5 shows a timing chart in the sub-pixel 100 when −5V is written in the data-writing period TD1.

Similarly to FIG. 4, shown in FIG. 5 are voltage waveforms (A) through (I) and state diagrams (J) and (K) of the switches SW1-SW2 in the first current path Pa and the switches SW3-SW4 in the second current path Pb. Among waveforms (A) through (I) in FIG. 5, waveforms (A)-(G) are completely the same as corresponding waveforms in FIG. 4.

Firstly, −5V is written on the node N1 (sub-pixel electrode Ep) during the data-writing period TD (see waveform (H)). Then, the refresh period TR1 starts after the blank period TB1. Different from the case in FIG. 4, in FIG. 5, although −5V is written on the node N1, the refresh circuit 101 operates in the same way as in FIG. 4 during the data-writing period TD1 and the blank period TB1.

The refresh switch SWr is ON during the refresh period TR1 (see waveform (E)). Accordingly, the voltage Vn3 on the node N3 is equal to the source line voltage Vsrc during the refresh period TR1 (see the single chain line in waveform (I)). Since the source line voltage Vsrc is 0V during the blank period TB2 (see waveform (B)), the voltage Vn3 on the node N3 also returns to 0V (see waveform (I)). The refresh period TR1 includes the blank period TB2, and the sample period Tsmpl starts subsequent to the blank period TB2.

During the sample period Tsmpl, the sample line voltage Vsmpl remains 10V (see waveform D)) and the voltage Vn1 on the node N1 is −5V (see waveform H)). Accordingly, the voltage Vgs-n1 across the sample switch SWs is 15V, which is sufficiently larger than the threshold voltage Vth (≈1V), thereby turning ON the sample switch SWs (see waveform D)). When the sample switch SWs is ON, the nodes N1 and N2 are electrically interconnected and the voltage Vn2 on the node N2 and the voltage Vn1 on the node N1 are equally −5V (see the solid line in waveform (I)). This condition is symbolically shown by an arrow A1 between waveforms (H) and (I). Accordingly, the sample capacitor Csmpl memorizes the −5V on the node N2. This means that the voltage written on the node N1 during the data-writing period TD1 is −5V.

It is to be noted that the voltages on the gate terminals G1 and G3 of the switches SW1 and SW3 in the voltage selection circuit 102 are also −5V because the voltage Vn2 on the node N2 is −5V (see the solid line in waveform (I)) during the sample period Tsmpl. On the other hand, the voltage Vn3 on the node N3 is 0V (see the single chain line in waveform (I)) during the sample period Tsmpl. Accordingly, the voltage Vg1-n3 across the switch SW1 is −5V and the switch SW1 is ON (see state diagram (J)). Although the switch SW1 is ON, the switches SW2 and SW4 remain OFF (see state diagrams (J) and (K)), there is no possibility that the source line voltage Vsrc is applied to the node N1 through the voltage selection circuit 102. Upon termination of the sample period Tsmpl, the reset period Treset starts after the blank period TB3.

As described hereinabove with reference to FIG. 5, since the sub-pixel switch SWp is ON in the reset period Treset (see waveform (C)), the source line voltage Vsrc (0V) is written on the node N1 and the voltage Vn1 on the node N1 changes from −5V to 0V. This condition is symbolically shown by an arrow A2 between waveforms (B) and (H). On the other hand, the control line voltages Vg2 and Vg4 on the control lines Lg2 and Lg4 are 10V during the reset period Treset (see waveforms (F) and (G)). Accordingly, since the voltages Vg2-n1 and Vg4-n1 across the switches SW2 and SW4 become 10V, switches SW2 and SW4 turn ON (see state diagrams (J) and (K)). As a result, similarly to the case in FIG. 4, 0V source line voltage Vsrc is written on the junction S12 between the switches SW1 and SW2 and also written on the junction S34 between the switches SW3 and SW4. Also, the voltage Vn3 on the node N3 is 0V during the reset period Treset (see the single chain line in waveform (I)). Accordingly, the voltages on the junctions S12 and S34 as well as the node N3 are all 0V during the reset period Treset. On the contrary, the voltage Vn2 on the node N2 is −5V during the reset period Treset (see the solid line in waveform (I)). Accordingly, since the voltages Vg3-s34 and Vg3-n3 across the switch SW3 are −5V, the switch SW3 is OFF (see state diagram (J)). It is to be noted that the switch SW1 remains ON (see state diagram (K)).

At the end of the reset period Treset, the first sub-refresh period Tsub-r1 and the second sub-refresh period Tsub-r2 start sequentially the blank period therebetween. As described hereinabove with reference to FIG. 4, the voltage selection circuit 102 receives the first refresh voltage (5V) in the first sub-refresh period Tsub-r1 and the second sub-refresh voltage (−5V) in the second sub-refresh period Tsub-r2. The voltage selection circuit 102 selects the refresh voltage necessary for inverting the polarity of the voltage written on the node N1 (sub-pixel electrode Ep) in the data writing period TD1 from the received first and second refresh voltages 5V and −5V and applies the selected voltage to the node N1. In FIG. 5, since −5V is written on the node N1 in the data writing period TD1 (see waveform (H)), it is necessary that the voltage selection circuit 102 selects the first refresh voltage (5V) and applies it to the node N1 in order to invert the polarity. In order to realize such voltage selection, the refresh circuit 101 operates as follows after termination of the reset period Treset.

A blank period TB4 is provided at the end of the reset period Treset but before starting the first sub-refresh period Tsub-r1. The switches SW2 and SW4 in the voltage selection circuit 102 return to OFF (see state diagrams (J) and (K)). Since the source line voltage Vsrc changes from 0V to 5V (see waveform (B)), the voltage Vn3 on the node N3 also changes from 0V to 5V (see the single chain line in waveform (I)). Since the node N3 is capacitively coupled to the node N2 through the sample capacitor Csmpl, when the voltage Vn3 on the node N3 changes from 0V to 5V, the voltage Vn2 on the node N2 changes from −5V to 0V (see the solid line in waveform (I)). Although the voltage Vn3 on the node N3 becomes 5V during the blank period TB4, the voltage Vn2 on the node N2 becomes 0V correspondingly and thus the switch SW1 in the voltage selection circuit 102 remains ON (see state diagram (J)). On the other hand, the switch SW3 remains OFF (see state diagram (K)).

At the end of the blank period TB4, the first sub-refresh period Tsub-r1 starts. Since both of the switches SW3 and SW4 in the second current path Pb are OFF (see state diagram (K)), the first refresh voltage (5V) received by the voltage selection circuit 102 is not outputted to the node N1 through the second current path Pb. However, since the switch SW2 is ON during the first sub-refresh period Tsub-r1 (see state diagram (J)), both of the switches SW1 and SW2 in the first current path Pa are ON. Accordingly, the first refresh voltage (5V) received by the voltage selection circuit 102 is outputted to the ode N1 through the first current path Pa. That is, since the voltage selection circuit 102 outputs the first refresh voltage (5V) that is received from the source line Lsrc onto the node N1, 5V is written on the node N1 (see waveform (H)). This condition is symbolically shown by an arrow A3 between waveforms (B) and (H).

There is a blank period TB5 after the end of the first sub-refresh period Tsub-r1 and before starting the second sub-refresh period Tsub-r2. The switches SW2 and SW4 in the voltage selection circuit 102 are OFF during the blank period TB5 (see state diagrams (J) and (K)). The source line voltage Vsrc and the voltage Vn3 on the node N3 change from 5V to −5V during the blank period TB5 (see waveforms (B) and (I)). Since the node N3 is capacitively coupled to the node N2 through the sample capacitor Csmpl, when the voltage Vn3 on the node N3 changes from 5V to −5V, the voltage Vn2 on the node N2 correspondingly changes from 0V to −10V (see the solid line in waveform (I)). Although the voltage Vn3 on the node N3 becomes −5V during the blank period TB5, the switch SW1 in the voltage selection circuit 102 remains ON because the voltage on the node N2 correspondingly becomes −10V (see the state diagram (J)). On the other hand, the switch SW3 remains OFF (see state diagram (K)).

Upon ending the blank period TB5, the second sub-refresh period Tsub-r2 starts. Since the switch SW2 remains OFF during the second sub-refresh period Tsub-r2 (see state diagram (J)), the second refresh voltage (−5V) received by the voltage selection circuit 102 is not outputted to the node N1 through the first current path Pa. On the other hand, during the second sub-refresh period Tsub-r2, the control line voltage Vg4 is 10V (see waveform (G)) and the voltage Vn1 on the node N1 is 5V (see waveform (H)), thus the voltage Vg4-n1 across the switch SW4 is 5V. Accordingly, the switch SW3 becomes ON (see state diagram (K)). However, since the switch SW3 remains OFF, the second refresh voltage (−5V) received by the voltage selection circuit 102 is not outputted to the node N1 through the second current path Pb. This means that the second refresh voltage (−5V) received by the voltage selection circuit 102 is unable to pass through the first and second current paths Pa and Pb and, thus not outputted to the node N1. Accordingly, the voltage Vn1 on the node N1 remains 5V (see waveform (H)).

A blank period TB6 follows at the end of the second sub-refresh period Tsub-r2. The source line voltage Vsrc changes from −5V to 0V during the blank period TB6 (see waveform (B)). Correspondingly, the voltage Vn3 on the node N3 changes from −5V to 0V (see the single chain line in waveform (I)) and the voltage Vn2 on the node N2 changes from −10V to −5V (see the solid line in waveform (I)). Subsequently, the refresh line voltage Vrfrsh on the refresh line Lrfrsh changes from 0V to −5V, thereby turning OFF the refresh switch SWr (see waveform (E)). This is the end of the refresh period TR1.

As described hereinabove, in FIG. 5, the voltage Vn1 (=−5V) that is written on the node N1 in the data writing period TD1 is memorized on the sample capacitor Csmpl in the sample period Tsmpl. Although the switch SW3 in the second current path Pb turns OFF before the start of the first sub-refresh period Tsub-r1 (see state diagram (K)), the switch SW1 in the first current path Pa turns ON (see state diagram (J)). Accordingly, by maintaining the switch SW2 ON during the first sub-refresh period Tsub-r1, the refresh voltage (5V) is written on the node N1. However, by maintaining the switch SW2 OFF during the second sub-refresh period Tsub-r2, the second refresh voltage (−5V) is not written on the node N1. In this way, −5V written on the node N1 in the data-writing period TD1 can be inverted into 5V. The first refresh voltage (5V) is simultaneously written on the sub-pixels 100 on which negative polarity voltage −5V is written in the data-writing period TD1 among the entire sub-pixels 100 of the display device 1 in accordance with the timing chart as shown in FIG. 5.

Upon ending the refresh period TR1, the hold period TH1 starts.

During the hold period TH1, the source line voltage Vsrc is constant 0V, the gate line voltage Vgate, the refresh line voltage Vrfrsh, the control line voltages Vg2 and Vg4 are −5V constant and the sample line voltage Vsmpl is −10V constant. As a result, the switches SWp, SWs, SWr, SW2 and SW4 within the sub-pixel 100 are held OFF. Accordingly, 5V on the node N1 is held during the hold period TH1 (see waveform (H)). The fact that 5V is held on the node N1 means that the sub-pixel 100 provides a display in the first tone. Accordingly, the sub-pixel 100 continues to display in the first tone over the entire time range from the data-writing period TD1 to the hold period TH1. It is to be noted in FIG. 5 that the voltage Vn1 on the node N1 is 0V for the entire time range from the reset period Treset to the blank period TB4. Accordingly, the sub-pixel 100 displays in the second tone rather than the first tone in the time duration from the reset period Treset to the blank period TB4. However, since the time duration from the reset period Treset to the blank period TB4 is very short, the viewer of the display device 1 is unable to recognize that the sub-pixel 100 displays in the second toe in the time duration from the reset period Treset to the blank period TB4. Consequently, the viewer recognizes as if the sub-pixel 100 continuously displays in the first tone for the entire time range from the data-writing period TD1 to the hold period TH1. Accordingly, it is to be noted that the phenomenon of the voltage Vn1 on the node N1 becoming 0V during the time from the reset period Treset to the blank period TB4 causes no influence to the viewer in recognizing the first tone.

In the above example, descriptions have been made on the refresh operation (see FIG. 4) when 5V is written in the data writing period TD1 and the refresh operation (see FIG. 5) when −5V is written in the data writing period TD1, i.e., the refresh operation when the sub-pixel 100 displays in the first tone. Now, the refresh operation when the sub-pixel 100 displays in the second tone will be described hereunder.

Figure 6:
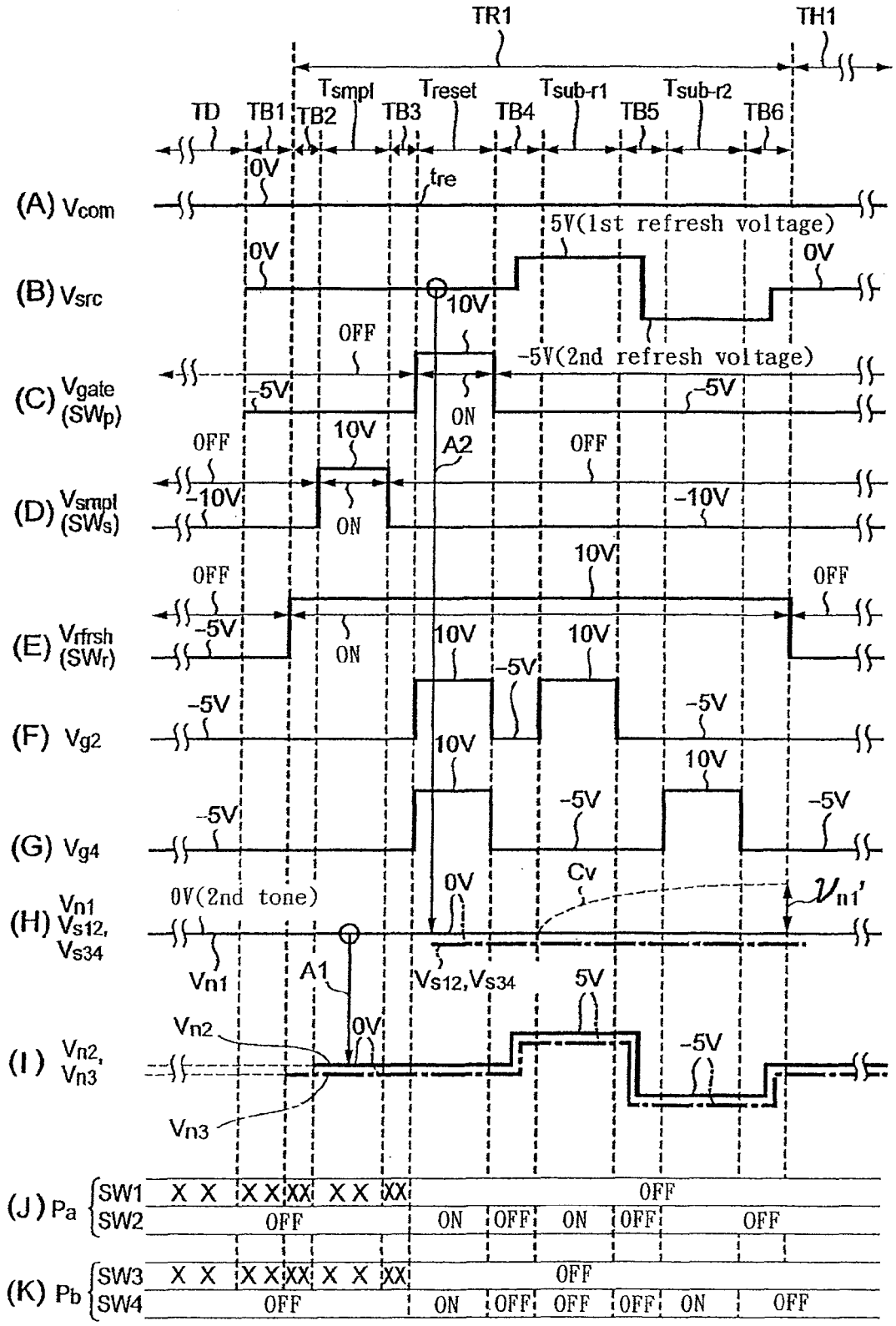
FIG. 6 shows a timing chart of the refresh operation when the sub-pixel 100 displays in the second tone.

FIG. 6 shows a timing chart for the refresh operation when the sub-pixel 100 displays in the second tone.

Similarly to FIG. 4 and FIG. 5, FIG. 6 shows voltage waveforms (A) through (I) as well as state diagrams (J) and (K) for the switches SW1-SW3 in the first current path Pa and the switches SW3-Sw4 in the second current path Pb, respectively. Among waveforms (A) through (I) in FIG. 6, waveforms (A) through (G) are completely the same as those in FIG. 4 and FIG. 5.

In order to cause the sub-pixel 100 to display in the second tone, it is necessary to write 0V on the node N1 (sub-pixel electrode Ep). For this end, 0V is written on the node N1 (sub-pixel electrode Ep) in the data-writing period TD1 (see waveform (H)). At the end of the data-writing period TD1, a refresh period TR1 starts through a blank period TB1. Although 0V is written on the node N1 in the data-writing period TD1 In FIG. 6 (see waveform (H)), different from the cases in FIG. 4 and FIG. 5, the operations of the refresh circuit 101 in the data-writing period TD1 and the blank period TB1 are exactly the same as those in FIG. 4 and FIG. 5.

The refresh switch SWr is ON during the refresh period TR1 (see waveform (E)). Accordingly, the voltage Vn3 on the node N3 is equal to the source line voltage Vsrc at least during the refresh period TR1 (see the single chain line in waveform (I)).

During the sample period Tsmpl, the sample line voltage Vsmpl is 10V (see waveform (D)) and the voltage Vn1 on the node N1 is 0V (see waveform (H)). Accordingly, the voltage Vgs-n1 across the sample switch SWs is 10V, which is sufficiently larger than the threshold voltage Vth (≈1V), thereby turning ON the sample switch SWs (see waveform (D)). When the sample switch SWs is ON, the nodes N1 and N2 are electrically interconnected and the voltage Vn2 on the node N2 is 0V and equal to the voltage Vn1 on the node N1 (see the solid line in waveform (I)). This condition is symbolically indicated by an arrow A1 between waveforms (H) and (I). It is to be noted that two voltages Vn2 (solid line) and Vn3 (single chain line) are shown in waveform (I). These voltages Vn2 and Vn3 have basically equal voltage level. However, it is to be noted that the voltages Vn2 and Vn3 are shown in waveform (I) by slightly shifting from each other for ease of recognizing the fact that waveform (I) includes two voltages Vn2 and Vn3. In this way, 0V that is written on the node N1 (sub-pixel electrode Ep) in the data-writing period TD1 is memorized on the sample capacitor Csmpl. The fact that the sample capacitor Csmpl memorized 0V on the node N2 (see the solid line in waveform (I)) means that the voltage written on the node N1 in the data writing period TD1 is 0V.

At the end of the sample period Tsmpl, a reset period Treset starts through a blank period TB3.

As described hereinabove with reference to FIG. 6, in the reset period Treset, 0V is written on the junction S12 between the switches SW1 and SW2 and also 0V is written on the junction S34 between the switches SW3 and SW4. Since the sub-pixel switch SWp is ON during the reset period Treset (see waveform (C)), the source line voltage Vsrc (=0V) is written on the node N1. This condition is indicated by an arrow A2 between waveforms (B) and (H). By writing 0V on the node N1 during the reset period Treset, it ensures to return the voltage Vn1 on the node N1 to 0V even if the voltage Vn1 on the node N1 is shifted from 0V at the start of the reset period Treset. On the other hand, since the control line voltages Vg2 and Vg4 for the switches SW2 and SW4 are 10V during the reset period Treset (see waveforms (F) and (G)), the voltages Vg2-n1 and Vg4-n1 across the switches SW2 and SW4 are 10V, thereby turning ON the switches SW2 and SW4 (see state diagrams (J) and (K)). Consequently, the 0V source line voltage Vsrc is written on the junction S12 between the switches SW1 and SW2 and the voltage Vs34 on the junction S34 between the switches SW3 and SW4 become 0V. The voltages Vs12 and Vs34 on the junctions S12 and S34 are shown in waveform (H) with single chain lines. The voltage Vn3 on the node N3 is also 0V during the reset period Treset (see the single chain line in waveform (I)). As a result, the voltages Vs12 and Vs34 on the junctions S12 and S34 as well as the voltage Vn3 on the node N3 are all 0V during the reset period Treset. Moreover, the voltage Vn2 on the node N2 is also 0V (see the solid line in waveform (I)). This means that the voltages Vg1-s12 and Vg1-n3 across the switch SW1 are 0V and the voltages Vg3-s34 and Vg3-n3 across the switch SW3 are also 0V, thereby turning OFF both of the switches SW1 and SW3 (see state diagrams (J) and (K)).

At the end of the reset period Treset, first and second sub-refresh period Tsub-r1 and Tsub-r2 start sequentially with a blank period therebetween. As described hereinabove with reference to FIG. 6, the voltage selection circuit 102 receives the first refresh voltage (5V) in the first sub-refresh period Tsub-r1 and also the second refresh voltage (−5V) in the second sub-refresh period Tsub-r2. Attention to be paid herein that 0V is the voltage written on the node N1 in the data-writing period TD1. Accordingly, if the voltage selection circuit 102 applies the received first refresh voltage (5V) or the second refresh voltage (−5V) onto the node N1, 5V or −5V is written on the node N1, thereby causing the sub-pixel 100 displays in different tones. In order that the sub-pixel 100 continues to display in a proper tone, it is necessary that the received first refresh voltage 5V or the second refresh voltage −5V is not applied to the node N1. For this end, the refresh circuit 101 operates in the following manner.

At the end of the reset period Treset but before the start of the first sub-refresh period Tsub-r1, there is provided a blank period TB4. During the blank period TB4, the switches SW2 and SW4 in the voltage selection circuit 102 return to the OFF state (see state diagrams (J) and (K)). Since the source line voltage Vsrc changes from 0V to 5V (see waveform (B)), the voltage Vn3 on the node N3 also changes from 0V to 5V (see the single chain line in waveform (I)). Since the node N3 is capacitively coupled to the node N2 through the sample capacitor Csmpl, when the voltage Vn3 on the node N3 changes from 0V to 5V, the voltage Vn2 on the node N2 also changes from 0V to 5V (see the solid line in waveform (I)). Although the voltage Vn3 on the node N3 becomes 5V in the blank period TB4, the switches SW1 and SW3 remain OFF because the voltage Vn2 on the node N2 becomes 5V correspondingly (see state diagrams (J) and (K)).

After the blank period TB4, the first sub-refresh period Tsub-r1 starts. Since the switch SW4 remains OFF during the first sub-refresh period Tsub-r1 (see state diagram (K)), the first refresh voltage (5V) received by the voltage selection circuit 102 is not outputted to the node N1 through the second current path Pb. On the other hand, the control line voltage Vg2 is 10V during the first sub-refresh period Tsub-r1 (see waveform (F)) and the voltage Vn1 on the node N1 is 0V (see waveform (H), the voltage Vg2-n1 across the switch SW2 is 10V and thus the switch SW2 is ON (see state diagram (J)). However, since the switch SW1 remains OFF, the first refresh voltage (5V) received by the voltage selection circuit 102 is not outputted to the node N1 through the first current path Pa. This means that the refresh voltage (5V) received by the voltage selection circuit 102 is unable to pass through the first current path Pa and the second current path Pb, thereby not outputted to the node N1. As a result, the voltage Vn1 on the node N1 remains 0V (see waveform (H)).

There is a blank period TB5 after the end of the first sub-refresh period Tsub-r1 but before the start of the second sub-refresh period Tsub-r2. During the blank period TB5, the switches SW2 and SW4 in the voltage selection circuit 102 are OFF (see state diagrams (J) and (K)). On the other hand, the source line voltage Vsrc and the voltage Vn3 on the node N3 changes from 5V to −5V (see waveforms (B) and (I)). Since the node N3 is capacitively coupled to the node N2 through the sample capacitor Csmpl, when the voltage Vn3 on the node N3 changes from 5V to −5V, the voltage Vn2 on the node N2 correspondingly changes from 5V to −5V (see the solid line in waveform (I)). Although the voltage Vn3 on the node N3 becomes −5V in the blank period TB5, the voltage on the node N2 becomes −5V correspondingly, therefore the switches SW1 and SW3 in the voltage selection circuit 102 remain OFF (see state diagrams (J) and (K)).

After the blank period TB5, the second sub-refresh period Tsub-r2 starts. Since the switches SW2 remains OFF during the second sub-refresh period Tsub-r2 (see state diagram (J)), the second refresh voltage (−5V) received by the voltage selection circuit 102 is not outputted to the node N1 through the first current path Pa. On the other hand, since the control line voltage Vg4 is 10V (see waveform (G)) and the voltage Vn1 on the node N1 is 0V (see waveform (I)) during the second sub-refresh period Tsub-r2, the voltage Vg4-n1 across the switch SW4 is 10V. Therefore, the switch SW4 is ON (see state diagram (J)). However, since the switch SW3 remains OFF, the second refresh voltage (−5V) received by the voltage selection circuit 102 is not outputted to the node N1 through the second current path Pb. This means that the second refresh voltage (−5V) received by the voltage selection circuit 102 is unable to pass through the first and second current paths Pa and Pb, thereby not outputted to the node N1. As a result, the voltage Vn1 on the node N1 remains 0V 8see waveform (H)).

Consequently, the first and second refresh voltages (5V and −5V) received by the voltage selection circuit 102 are not applied to the node N1. And the voltage Vn1 on the node N1 is held 0V during the refresh period TR1.

Upon ending the refresh period TR1, a hold period TH1 starts. The voltage Vn1 on the node N1 is continuously held 0V during the hold period TH1. Among the entire sub-pixels 100 of the display device 1, the voltage of any sub-pixel 100 on which 0V is written in the data writing period TD1 is held 0V in accordance with the timing chart in FIG. 6. Consequently, it continues to display in the second tone over the entire time from the refresh period TR1 to the hold period TH1.

It is to be noted in FIG. 6 that 0V is written on the junctions S12 and S34 in the reset period Treset (see the arrow A2), thereby restricting the voltages Vs12 and Vs34 on the junctions S12 and S34 to 0V during the reset period Treset. If it is assumed that there is no 0V written on the junctions S12 and S34 in the reset period Treset, the first and second sub-refresh periods Tsub-r1 and Tsub-r2 start sequentially while the voltages Vs12 and Vs34 on the junctions S12 and S34 are indefinite (i.e., unknown whether 0V or not). Since the switch SW2 is ON during the first sub-refresh period Tsub-r1 (see state diagram (J)), the junction S12 is electrically connected to the node N1. On the other hand, since the switch SW4 is ON during the second sub-refresh period Tsub-r2 (see state diagram (K)), the junction S34 is electrically connected to the node N1. Accordingly, if the voltage Vs12 on the junction S12 or the voltage Vs34 on the junction S34 is shifted from 0V, there is a possibility that the voltage Vn1 on the node N1 is shifted from 0V. For example, if the voltage Vn1 on the node N1 varies along a curve Cv, it may result in shifting from 0V to vn1' (see waveform (H)). Since this voltage vn1' is held during the hold period TH1, there is a possibility of encountering deteriorated image quality if the voltage vn1' is not a negligible value.

However, in this embodiment, 0V is written on the junctions S12 and S34 in the reset period Treset. As a result, even if the node N1 may be connected to the junctions S12 and S34 in the first and second sub-refresh periods Tsub-r1 and tsub-r2, it ensures that the voltage Vn1 on the node N1 is held to 0V, thereby effectively avoiding image quality deterioration. It is to be noted that a parasitic capacitance C12 between the two switches SW1 and SW2 and a parasitic capacitance C34 between the two switches SW3 and SW4 are significantly smaller than the sub-pixel capacitance Cpixel. For example, the parasitic capacitance C12 or C34 is one several hundredth as compared to the sub-pixel capacitance Cpixel. As a result, if the parasitic capacitance C12 or C34 is negligibly smaller as compared to the sub-pixel capacitance Cpixel, the value vn1' is also negligible, thereby enabling to substantially neglect image quality deterioration. In this case, it is possible to abbreviate the operation to write 0V on the junctions S12 and S34 in the reset period Treset.

In this embodiment, even if any one of the voltages 0V, 5V and −5V may be written on the node N1 in the data-writing period TD1, the switch SW2 is ON and the switch SW4 is OFF in the first sub-refresh period Tsub-r1, while the switch SW2 is OFF and the switch SW4 is ON in the second sub-refresh period Tsub-r2. However, in case of writing 5V on the node N1 in the data-writing period TD1 (see FIG. 4), the switch SW3 in the voltage selection circuit 102 becomes ON, while in case of writing −5V on the node N1 in the data-writing period TD1 (see FIG. 5), the switch SW1 in the voltage selection circuit 102 becomes ON. As a result, in case of writing 5V on the node N1 in the data-writing period TD1 (see FIG. 4), the voltage selection circuit 102 is able to apply the second refresh voltage (−5V) to the node N1 in the second sub-refresh period Tsub-r2 through the second current path Pb. On the other hand, in case of writing −5V on the node N1 in the data-writing period TD1 (see FIG. 5), the voltage selection circuit 102 is able to apply a first refresh voltage (5V) to the node N1 through the first current path Pa. This means that even if either 5V or −5V may be written on the node N1 in the data-writing period TD1, the polarity of the voltage written on the node N1 can be inverted.

On the other hand, in case of writing 0V on the node N1 in the data-writing period TD1 (see FIG. 6), since both of the switches SW1 and SW3 in the voltage selection circuit 102 become OFF, the voltage selection circuit 102 does not select either one of the first and second refresh voltages (5V and −5V). As a result, the voltage Vn1 on the node N1 is held 0V.

Although description is made in FIGS. 4-6 on the operation in the refresh period TR1 and the hold period TH1, the display device 1 repeats the refresh operation as described hereinabove See FIG. 3). Now, operations of the display device subsequent to the hold period TH1 will be described.

At the end of the hold period TH1, the refresh period TR2 starts (see FIG. 3). In case of writing −5V or 5V on the node N1 in the previous period TR1, an operation of further inverting the polarity of the voltage will be performed in the refresh period TR2. For example, if −5V is written on the node N1 in the previous refresh period TR1 (see FIG. 4), an operation of further inverting the polarity of −5V and writing 5V will be performed in the refresh period TR2. In order to rewrite 5V in place for −5V, it is enough to repeat the same operation as that in the refresh period TR1 in FIG. 5. Such operation enables to rewrite 5V by replacing −5V. On the other hand, if 5V is written on the node N1 in the previous refresh period TR1 (see FIG. 5), the polarity of 5V is inverted and −5V is written in the refresh period TR2. In order to rewrite −5V instead of 5V, it is enough to repeat the operation as that in the refresh period TR1 in FIG. 4. Such operation enables to rewrite −5V instead of 5V. It is to be noted that in case of writing 0V on the node N1 in the previous refresh period TR1 (see FIG. 6), an operation will be performed in the refresh period TR2 for maintaining 0V. It is enough to repeat the same operation as that in the refresh period TR1 in FIG. 6. This operation enables to maintain 0V without changing it. After the refresh period TR2, a hold period TH2 starts In the hold period TH2, the voltage on the node N1 at the end time of the refresh period TR2 is held. After the hold period TH2, a refresh period TR3 starts (see FIG. 3). If −5V or 5V is written on the node N1 in the previous refresh period TR2, an operation for further inverting the polarity of such voltage is performed in the refresh period TR3. For example, if 5V is written on the node N1 in the previous refresh period TR2, the polarity of 5V is inverted again and −5V is written in the refresh period TR3. In order to replace 5V with −5V, the same operation as that in the refresh period in FIG. 4 is repeated. This operation enables to rewrite −5V instead of 5V in the refresh period TR3. On the other hand, if −5V is written on the node N1 in the previous refresh period TR2, the polarity of −5V is inverted and 5V is written in the refresh period TR3. In order to rewrite 5V instead of −5V, the same operation as that in the refresh period TR1 in FIG. 5 is repeated. This operation enables to rewrite 5V instead of −5V in the refresh period TR3. It is to be noted that in case of writing 0V on the node N1 in the previous refresh period TR2, an operation is performed for maintaining 0V in the refresh period TR3. In order to maintain 0V, the same operation as that in the refresh period TR1 in FIG. 6 is repeated. This operation enables to maintain 0V without changing. At the end of the refresh period TR3, a hold period TH3 starts During the hold period TH3, the voltage on the node N1 at the end of the refresh period TR3 is held.

Similar operations are repeated hereinafter, and the operation for inverting the polarity of the voltage from 5V to −5V or from −5V to 5V, or maintaining 0V is continued until the start of the subsequent data-writing period TD2 (see FIG. 3).

The display device 1 performs the foregoing operations for continuously displaying images.

In this embodiment, the first refresh voltage (5V) is simultaneously applied to all source lines Lsrc during the first sub-refresh period Tsub-r1, while simultaneously applying the second refresh voltage (−5V) during the second sub-refresh period Tsub-r2 (see waveform (B)). At this time, the voltage selection circuits 102 for all sub-pixels 100 either apply the first or second refresh voltage (5V or −5V) to the node N1, or prohibit application of the first or second refresh voltage to the node N1 depending on the voltages memorized on the sample capacitors Csmpl. In this way, the refresh operation for all sub-pixels 100 is performed simultaneously. That is, by applying the first and second refresh voltages (5V and −5V) once to each source line Lsrc from the source driver 30 (see FIG. 1) during each refresh period TR1, . . . , TRn, the display device 1 is able to simultaneously refresh all sub-pixels 100. Accordingly, even if N sub-pixels 100 may be connected, there is no need to continuously applying n data voltages to each source line Lsrc, but it is enough to apply the first and second refresh voltages once. Therefore, it is possible to drive the source driver 30 for supplying the source line voltage Vsrc to the source line Lsrc with low power consumption.

Moreover, since the sub-pixel switch SWp is turned ON in each refresh period TR1, TR2, . . . , TRn, the display device 1 is designed to supply 10V ON voltage (see waveform (C)) once to each gate line Lgate in order to turn ON the sub-pixel switch SWp. Accordingly, for example, even if M sub-pixels 100 may be connected to each gate line Lgate, there is no need to continuously supply M ON voltages to each gate line Lgate. This enables to drive the gate driver 20 for supplying the gate line voltage to the gate lines Lgate with low power consumption.

Furthermore, the display device 1 is able to reduce flicker because the refresh operation for all sub-pixels 100 is carried out simultaneously in each refresh period, TR1, TRn.

Now, another embodiment will be described hereunder.

Figure 7:
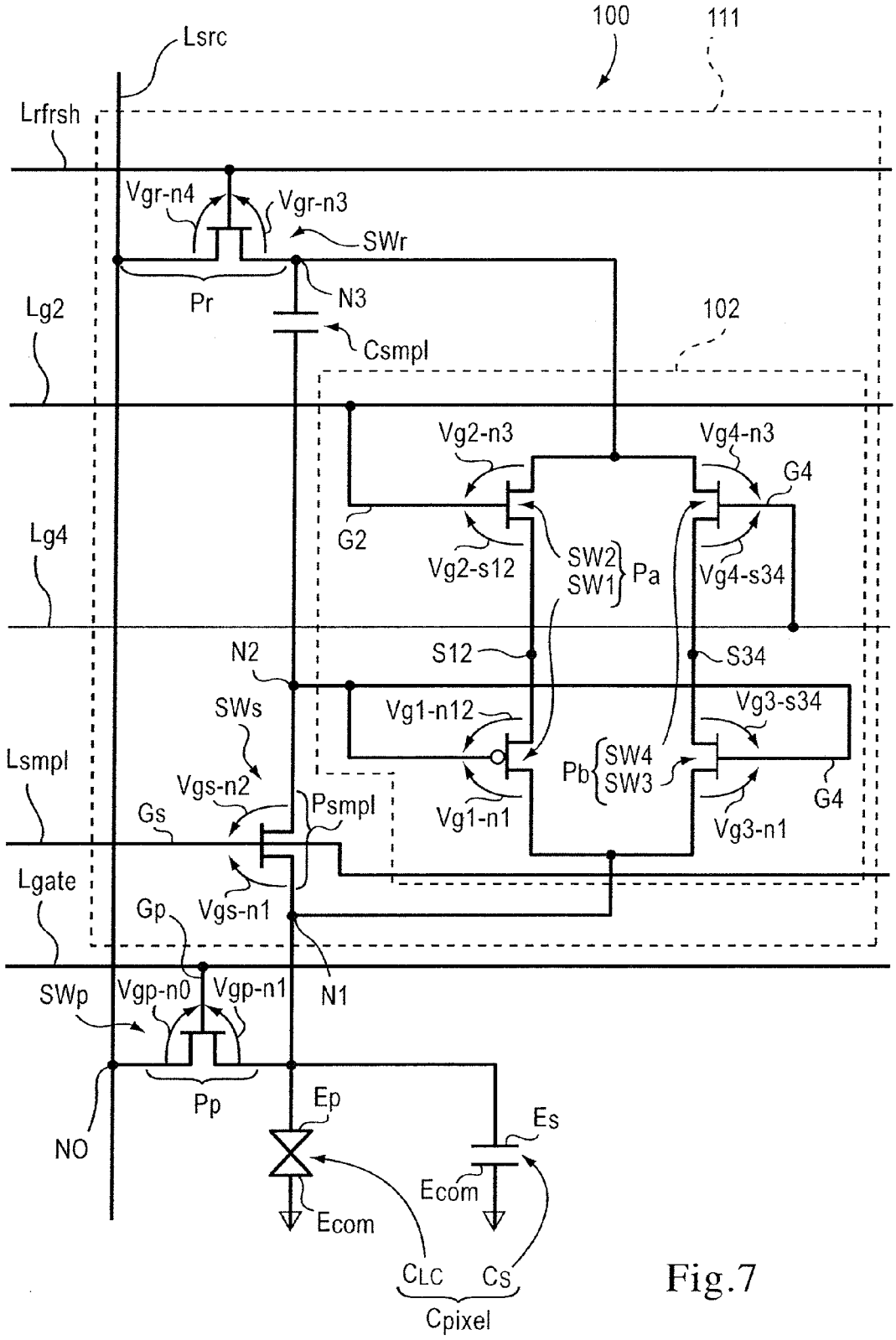
FIG. 7 is a simplified schematic of the sub-pixel 100 employing another refresh circuit 111.

FIG. 7 is a simplified schematic showing a sub-pixel 100 provided with another refresh circuit 111.

Only differences between the refresh circuits 111 and 101 in FIG. 7 and FIG. 2 is that the switches SW1 and SW3 side of the voltage selection circuit 102 is connected to the node N1, while the switches SW2 and SW4 side is connected to the node N3 in the refresh circuit 111 in FIG. 7.

Now, the operation of the refresh circuit 111 will be described hereunder.

Figure 8:
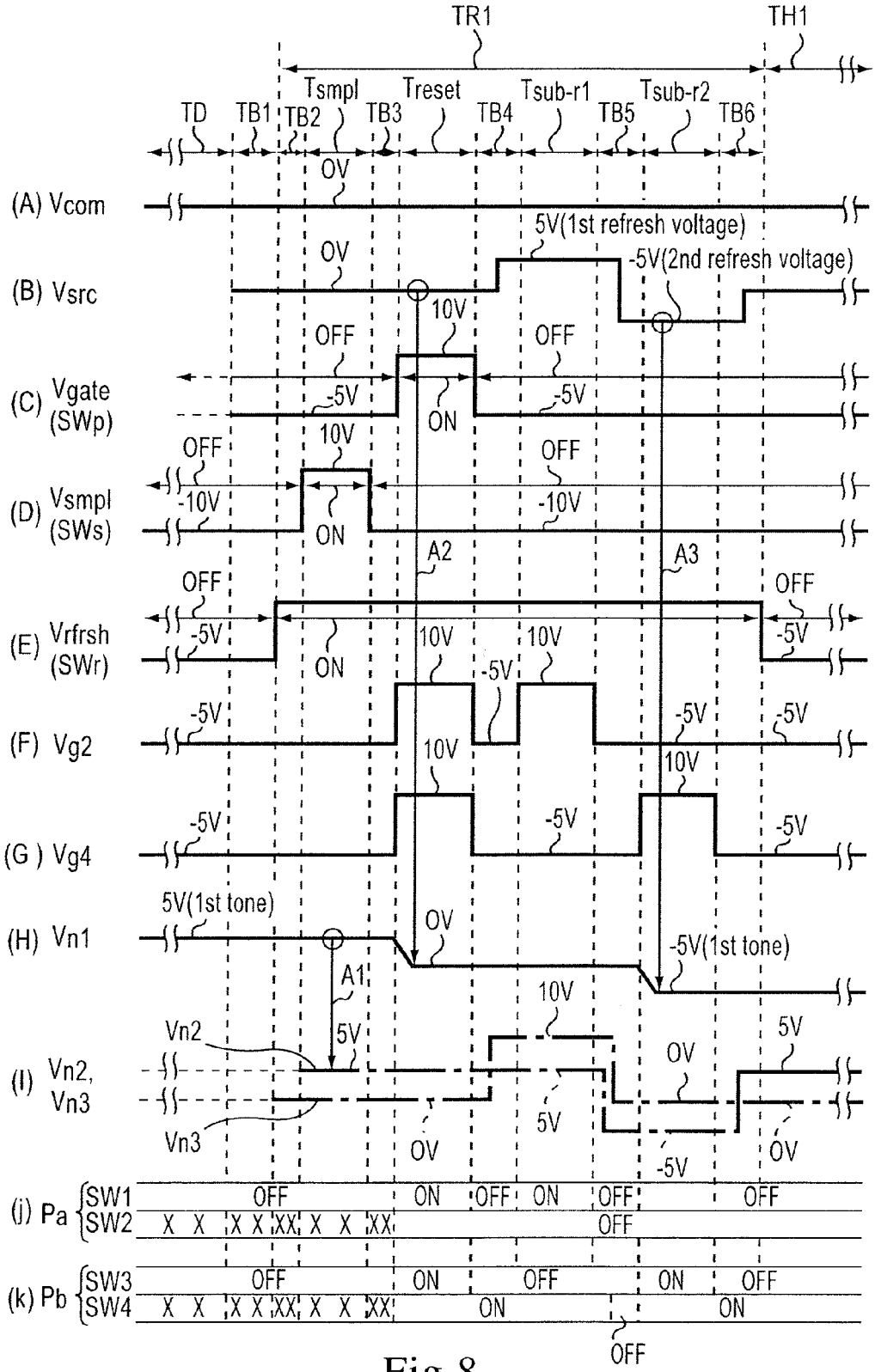
FIG. 8 shows a timing chart of the refresh circuit 111.

FIG. 8 is the timing chart of the refresh circuit 111.

Similar to FIG. 4, shown in FIG. 8 are voltage waveforms (A)-(I) and state diagrams (J) and (K) indicating respectively states of the switches SW1 and SW2 in the first current path Pa and the switches SW3 and SW4 in the second current path Pb. Among waveforms (A)-(I) in FIG. 8, waveforms (A)-(G) are exactly the same as those in FIG. 4.

Firstly, voltage is written on the node N1 (sub-pixel electrode Ep) during the data-writing period TD1 (see waveform (H)). Similar to the case in FIG. 4, it is described herein that 5V is written during the data-writing period TD1 in this embodiment. Since operations in the data-writing period TD1 and the blank period TB1 are identical to those in FIG. 4, no descriptions will be given herein. At the end of the blank period TB1, the refresh period TR1 starts.

The refresh switch SWr is ON during the refresh period TR1 (see waveform (E)). Accordingly, the voltage Vn3 on the node N3 is equal to the source line voltage Vsrc during the refresh period TR1 (see the single chain line in waveform (I)). The refresh period TR1 includes the blank period TB2 and the sample period Tsmpl starts subsequent to the blank period TB2.

Since the sample line voltage Vsmpl is 10V during the sample period Tsmpl (see waveform (D)), the voltage Vn1 on the node N1 is 5V (see waveform (H)). As a result, the voltage Vgs-n1 across the sample switch SWs is 5V, which is sufficiently larger than the threshold voltage Vth (≈1V) and thus the sample switch SWs becomes ON (see waveform (D)). Since the sample switch SWs is OB, the nodes N1 and N2 are electrically interconnected and the voltage Vn2 on the node N2 is 5V or equal to the voltage Vn1 on the node N1 (see the solid line in waveform (I)). This condition is symbolically indicated by an arrow A1 between waveforms (H) and (I). In this manner, the voltage 5V written on the node N1 (sub-pixel electrode Ep) in the data writing period TD1 is memorized on the sample capacitor Csmpl. The fact that the sample capacitor Csmpl memorized 5V on the node N2 means that the 5V is the voltage written on the node N1 in the data-writing period TD1.

It is to be noted that the switches SW2 and SW4 are OFF during the sample period Tsmpl (see state diagrams (J) and (K)). Therefore, there is no possibility that the source line voltage Vsrc is applied to the node N1 through the voltage selection circuit 102. At the end of the sample period Tsmpl, the reset period Treset starts by way of the blank period TB3.

Since the sub-pixel switch SWp is ON during the reset period Treset (see waveform (C)), the source line voltage Vsrc (0V) is written on the node N1 and the voltage Vn1 on the node N1 changes from 5V to 0V (see waveform (H)). This condition is symbolically indicated by an arrow A2 between waveforms (B) and (H)). On the other hand, the control line voltages Vg2 and Vg4 for the switches SW2 and SW4 are 10V during the reset period Treset (see waveforms (F) and (G)) and the voltage Vn3 on the node N3 is 0V (see the single chain line in waveform (I)). As a result, the voltages Vg2-n3 and Vg4-n3 across the switches SW2 and SW4 are 10V. Therefore, the switches SW2 and SW4 turn ON (see state diagrams (J) and (K)) and the source line voltage Vsrc (0V) is written on the junctions S12 and S34 through the switches SW2 and SW4 from the refresh switch SWr. Due to such operation during the reset period Treset, 0V is written on the junctions S12 and S34, thereby fixing the voltages on the junctions S12 and S34 to 0V.

It is to be noted that the voltage on the junction S12 and the voltage Vn1 on the node N1 are 0V (see waveform (H)) and the voltage Vn2 on the node N2 is 5V (see the solid line in waveform (I)) during the reset period Treset. Therefore, the switch SW1 is ON (see state diagram (J)) and the switch SW3 is ON (see state diagram (K)). This means that the entire second current path Pb is ON and the node N3 is connected to the node N1. As a result, 0V is written on the node N1 from the source line Lsrc through the sub-pixel switch SWp and also 0V is written from the source line Lsrc through the refresh switch SWr and the second current path Pb.

When the reset period Treset ends, the first sub-refresh period Tsub-r1 and the second sub-refresh period Tsub-r2 start sequentially with the blank period therebetween. The voltage selection circuit 102 receives respectively the first and second refresh voltages 5V and −5V in the first and second sub-refresh periods Tsub-r1 and Tsub-r2 from the source line Lsrc through the refresh switch SWr. The voltage selection circuit 102 selects either one of the received first and second refresh voltages 5V and −5V that is necessary for inverting the polarity of the voltage written on the node N1 (sub-pixel electrode Ep) in the data-writing period TD1 and supplies the selected voltage to the node N1. In FIG. 8, since 5V is written on the node N1 in the data-writing period TD1 (see waveform (H)), it is necessary that the voltage selection circuit 102 selects the second refresh voltage (−5V) in order to invert the polarity and to supply it to the node N1. In order to realize such voltage selection, the refresh circuit 111 operates after the end of the reset period Treset as follows.

There is the blank period TB4 after the end of the reset period Treset but before the start of the first sub-refresh period Tsub-r1. During the blank period TB4, the switches SW2 and SW4 in the voltage selection circuit 102 are OFF (see state diagrams (J) and (K)). On the other hand, since the source line voltage Vsrc changes from 0V to 5V, the voltage Vn3 on the node N3 also changes from 0V to 5V (see the single chain line in waveform (I)). Since the node N3 is capacitively coupled to the node N2 through the sample capacitor Csmpl, if the voltage Vn3 on the node N3 changes from 0V to 5V, the voltage Vn2 on the node N2 changes from 5V to 10V (see the solid line in waveform (I)).

When the blank period TB4 ends, the first sub-refresh period Tsub-r1 starts. Since the control line voltage Vg2 is 10V during the first sub-refresh period Tsub-r1 (see waveform (F)), the switch SW2 becomes OFF (see state diagram (J)). Although the switch SW2 becomes OFF, the first refresh voltage (5V) that the voltage selection circuit 102 received is not outputted to the node N1 through the first current path Pa because the switch SW1 is ON. Moreover, since the control line voltage Vg4 remains −5V during the first sub-refresh period (see waveform (G)), the switch SW4 remains ON (see state diagram (K)). As a result, the first refresh voltage (5V) that the voltage selection circuit 102 received is not outputted to the node N1 through the second current path. That is, the voltage selection circuit 102 does not output the received first refresh voltage (5V) to the node N1 and the voltage Vn1 on the node N1 remains 0V.

There is the blank period TB5 after the end of the first sub-refresh period Tsub-r1 but before the start of the second sub-refresh period Tsub-r2. The switches SW2 and SW4 in the voltage selection circuit 102 are OFF (see state diagrams (J) and (K)). On the other hand, the source line voltage Vsrc changes from 5V to −5V during the blank period TB5 (see waveform (B)). When the source line voltage Vsrc changes from 5V to −5V, the voltage Vn2 on the node N2 correspondingly changes from 10V to 0V (see waveform (I)). Since the voltage Vn1 on the node N1 is 0V and the voltage Vn2 on the node N2 changes from 10V to 0V during the blank period TB5, the switch SW1 remains OFF (see state diagram (J)), while the other switch SW3 changes from OFF to ON (see state diagram (K)).

When the blank period TB5 ends, the second sub-refresh period Tsub-r2 starts. During the second sub-refresh period Tsub-r2, the second refresh voltage (−5V) received by the voltage selection circuit 102 is not outputted to the node N1 through the second current path Pb because the switch SW2 remains OFF (see state diagram (J)). On the other hand, during the second sub-refresh period Tsub-r2, the control line voltage Vg4 is 10V (see waveform (G)) and the voltage Vn3 on the node N3 is −5V (see the single chain line in waveform (I)), the voltage Vg4-n3 across the switch SW4 is 15V. Thus, the switch SW4 becomes ON (see state diagram (K)). When the switch SW4 becomes ON, the voltage on the Junction S34 and the voltage Vn3 on the node N3 are equal to each other and the voltage Vg3-s34 across the switch SW3 is 5V, thereby turning ON the switch SW3. Now that both switches SW3 and Sw4 are ON, the entire second current path Pb is ON and the second refresh voltage (−5V) is written on the node N1 through the second current path Pb. This condition is symbolically indicated by an arrow A3 between waveforms (B) and (H).

When the second sub-refresh period Tsub-r2 ends, the refresh switch SWr becomes OFF, which ends the refresh period TR1.

As described hereinabove with reference to FIG. 8, in the display device 1, since the switches SW1 and SW4 are ON during the first sub-refresh period Tsub-r1, the voltage selection circuit 102 does not output the first refresh voltage (5V) to the node N1. However, since the entire second current path Pb is ON during the second sub-refresh period Tsub-r2, the second refresh voltage (−5V) is outputted to the node N1 through the second current path Pb. In the above manner, 5V that is written on the node N1 during the data-writing period TD1 can be inverted to −5V.

When the refresh period TR1 ends, the hold period TH1 starts and the −5V written on the node N1 is held. The fact that −5V is held on the node N1 means that the sub-pixel 100 is displaying in the first tone. Accordingly, the sub-pixel 100 keeps displaying in the first tone throughout the time from the data-writing period TD1 and the hold period TH1. It is to be noted in FIG. 8 that the voltage Vn1 on the node N1 is 0V for the time from the reset period Treset to the blank period TB5. However, since the time from the reset period Treset to the blank period TB5 is very short, the viewer is most likely to recognize that the display is continuously in the first tone for the time from the data-writing period TD1 to the hold period TH1. Consequently, it is to be noted that the fact that the voltage Vn1 on the node N1 is 0V for the time from the reset period Treset to the blank period TB5 has no influence on the viewer's recognition of the first tone.

FIG. 8 shows the refresh operation in case of writing 5V on the node N1 in the data-writing period TD1 in order to cause the sub-pixel 100 to display in the first tone. When −5V is written on the node N1 in the data writing period TD1, the first refresh voltage (5V) is written on the node N1 in the first sub-refresh period Tsub-r1 and the second refresh voltage (−5V) is not written on the node N1 in the second sub-refresh period Tsub-r2. As a result, it is possible to invert −5V written on the node N1 in the data-writing period TD1 to 5V.

On the other hand, when 0V is written on the node N1 in the data writing period TD1, since the voltage selection circuit 102 does not supply the first and second refresh voltages (5V and −5V) on the node N1, the voltage on the node N1 remains 0V.

When the refresh period TR1 ends, the voltage Vn1 on the node N1 at the end of the refresh period TR1 is maintained during the hold period TH1. Subsequently, the refresh operation and the hold operation are repeated.

Even in case of using the refresh circuit 111 as shown in FIG. 7, the source driver 30 and the gate driver 20 (see FIG. 1) are able to drive at low power consumption.

Although the sample line Lsmpl and the control lines Lg2 and Lg4 are supplied from the gate driver 20 in the above embodiment, it is also possible that all or a part of the sample line Lsmpl and the control lines Lg2 and Lg4 are supplied from the source driver 30.

Now, a description will be made hereunder on some other modified examples of the refresh circuit.

Figure 9:
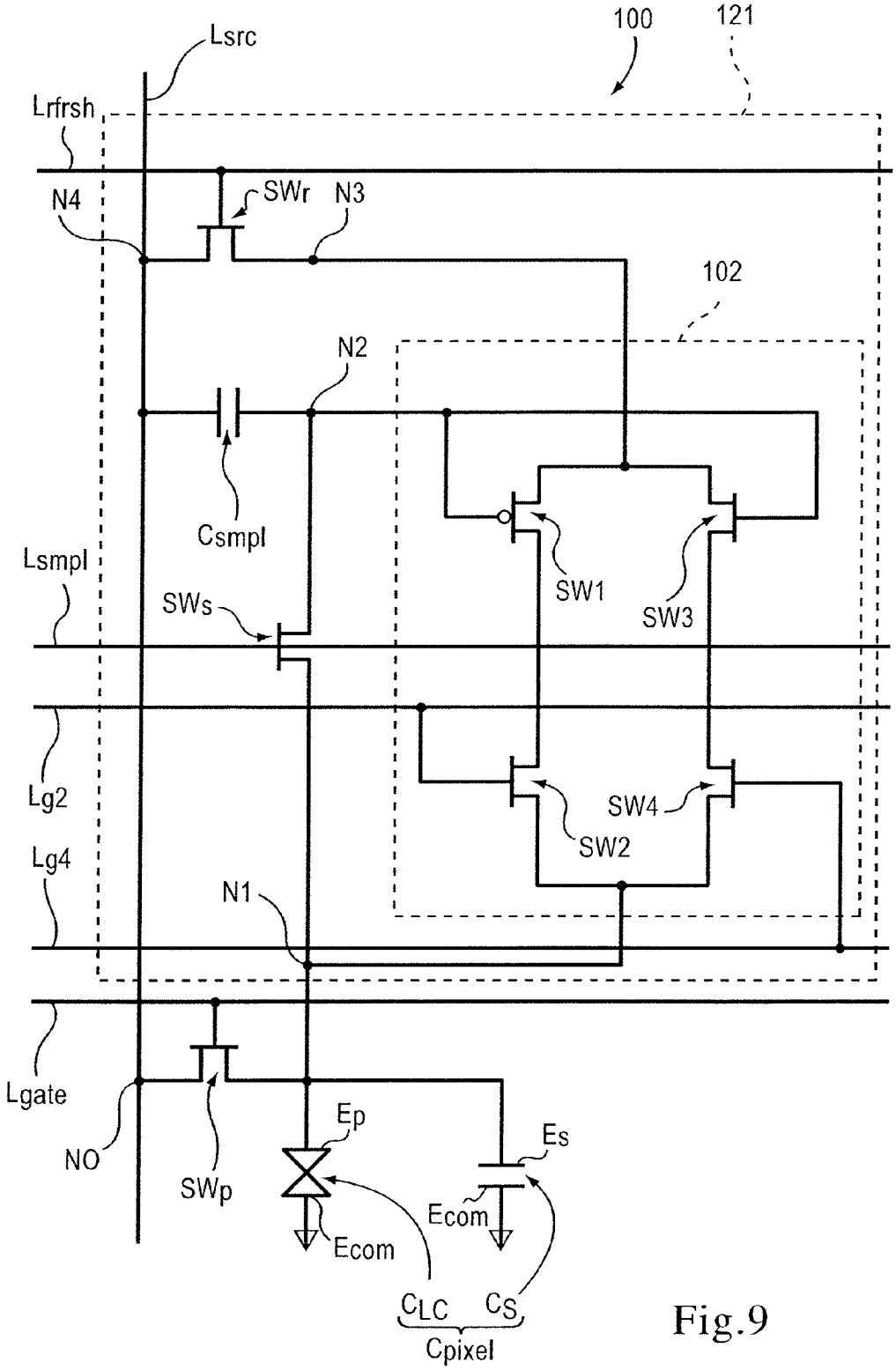
FIG. 9 is a simplified schematic to show the sub-pixel 100 employing a refresh circuit 121 that is a modified example of the refresh circuit 101 as shown in FIG. 2.

FIG. 9 is a simplified schematic to show a sub-pixel 100 having a refresh circuit 121 that is a modification of the refresh circuit 101 as shown in FIG. 2.

Only difference between FIG. 9 and FIG. 2 is that one end of the sample capacitor Csmpl in FIG. 2 is connected to the node N3 between the refresh switch SWr and the voltage selection circuit 102, while one end of the sample capacitor Csmpl in FIG. 9 is directly connected to the source line Lsrc. Although one end of the sample capacitor Csmpl is directly connected to the source line lsrc, the operation of the refresh circuit 121 in the refresh period and the hold period is basically the same as that of the refresh circuit 101 as shown in FIG. 2. As a result, even if the refresh circuit 121 as shown in FIG. 9 may be used, it is also possible to drive the gate driver 20 and the source driver 30 at low power consumption.

Figure 10:
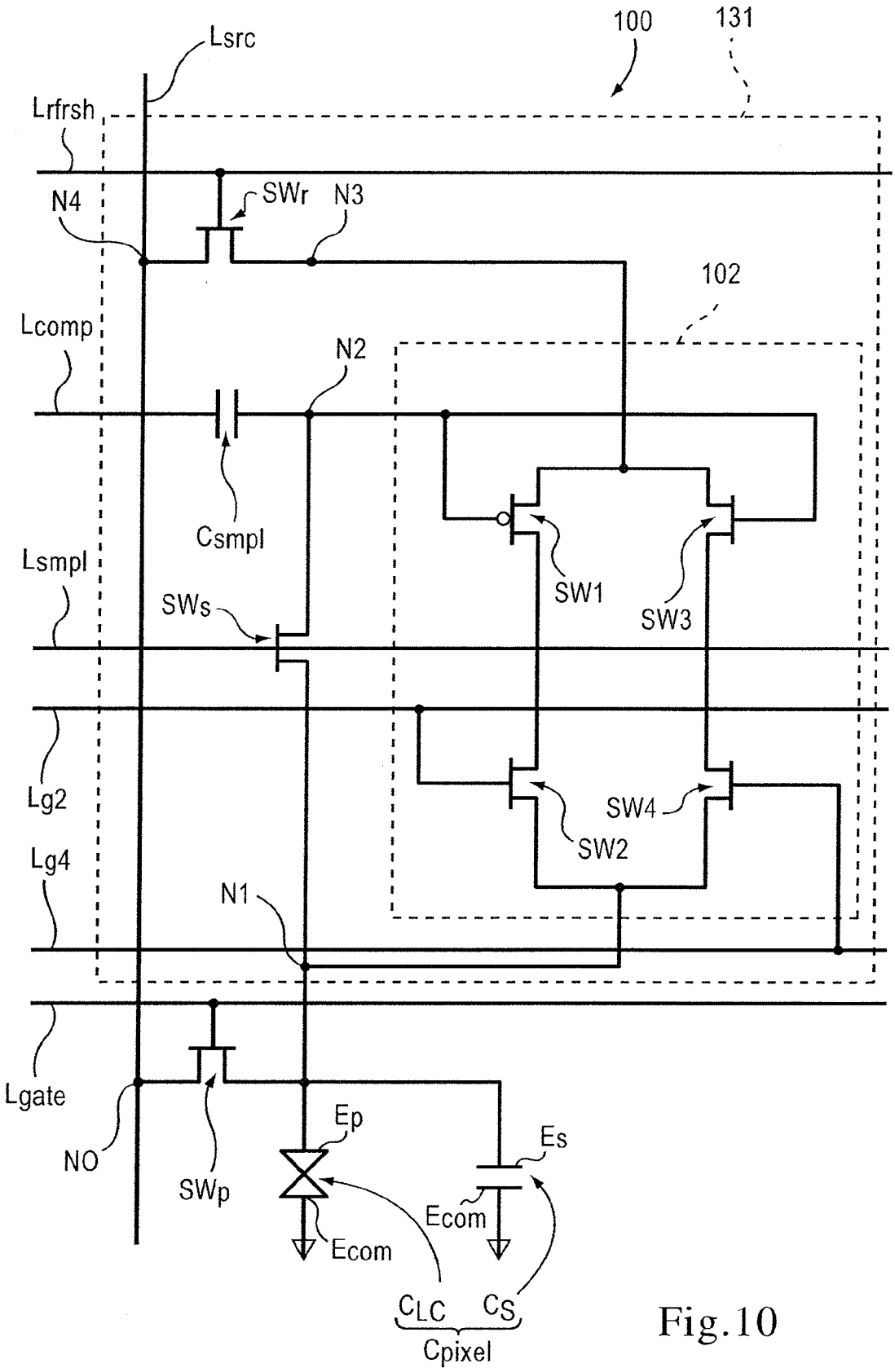
FIG. 10 is a simplified schematic of the sub-pixel 100 employing a refresh circuit 131 that is a modified example of the refresh circuit 101 as shown in FIG. 2.

FIG. 10 is a simplified schematic to show the sub-pixel 100 having a refresh circuit 131 that is a modification of the refresh circuit 101 as shown in FIG. 2.

Differences between FIG. 10 and FIG. 2 include that a compensation line Lcomp is provided in FIG. 10 and that one end of the sample capacitor Csmpl in FIG. 2 is connected to the node N3, while one end of the sample capacitor Csmpl in FIG. 10 is connected to the compensation line Lcomp. The operation of the refresh circuit 131 in the refresh period and the hold period is basically the same as that of the refresh circuit 101 in FIG. 2. As a result, even if the refresh circuit 131 as shown in FIG. 10 may be used, it is also possible to drive the gate driver 30 and the source driver 30 at low power consumption.

Since the node N2 is capacitively coupled to the source line Lsrc through the sample capacitor Csmpl in the refresh circuit 121 as shown in FIG. 9, the voltage Vn2 on the node N2 also changes depending on the source line voltage Vsrc. Accordingly, in the refresh circuit 121 as shown in FIG. 9, the switches SW1 and SW2 that are connected to the node N2 become ON or OFF state depending on the source line voltage Vsrc. On the other hand, in the refresh circuit 131 as shown in FIG. 10, since the sample capacitor Csmpl is connected to the compensation line Lcomp rather than the source line Lsrc, it is possible to adjust the voltage Vn2 on the node N2 independent from the source line voltage Vsrc. As a result, in the refresh circuit 131 as shown in FIG. 10, it is possible to adjust ON or OFF state of the switches SW1 and SW3 connected to the node N2 independent from the source line voltage Vsrc by adjusting the voltage on the compensation line Lcomp, thereby enabling the voltage selection circuit 102 to operate in an optimum condition.

It is to be noted that the refresh circuit 111 as shown in FIG. 7 can be modified similarly to FIG. 9 and FIG. 10.

Although the refresh circuit in the foregoing embodiments is provided with the refresh switch SWr, it is possible to eliminate the refresh switch SWr. Examples of the refresh circuit excluding such refresh switch SWr will be described hereunder.

Figure 11:
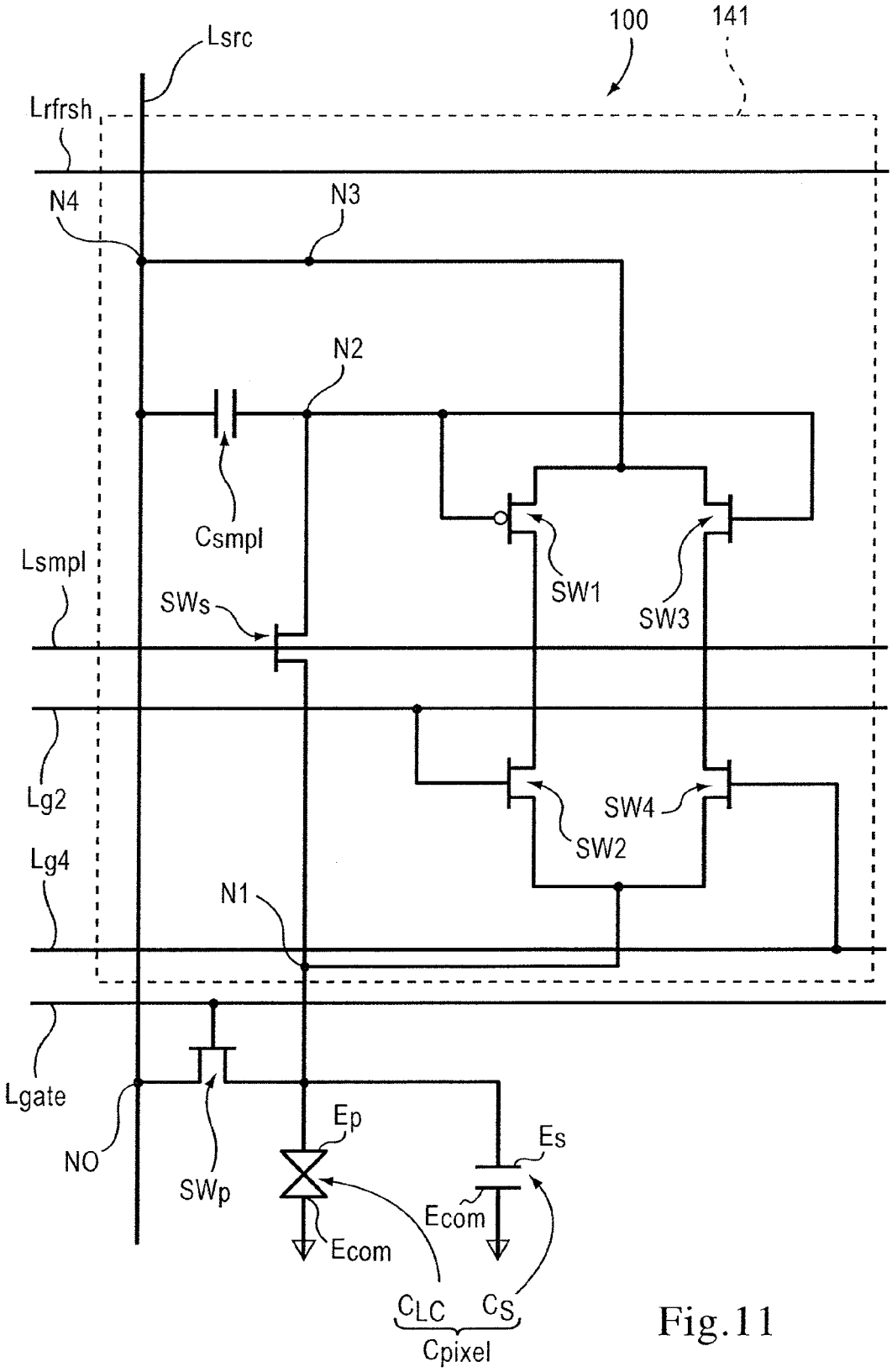
FIG. 11 is a simplified block diagram to show the sub-pixel employing a refresh circuit 141 having no refresh switch SWr.
Figure 12:
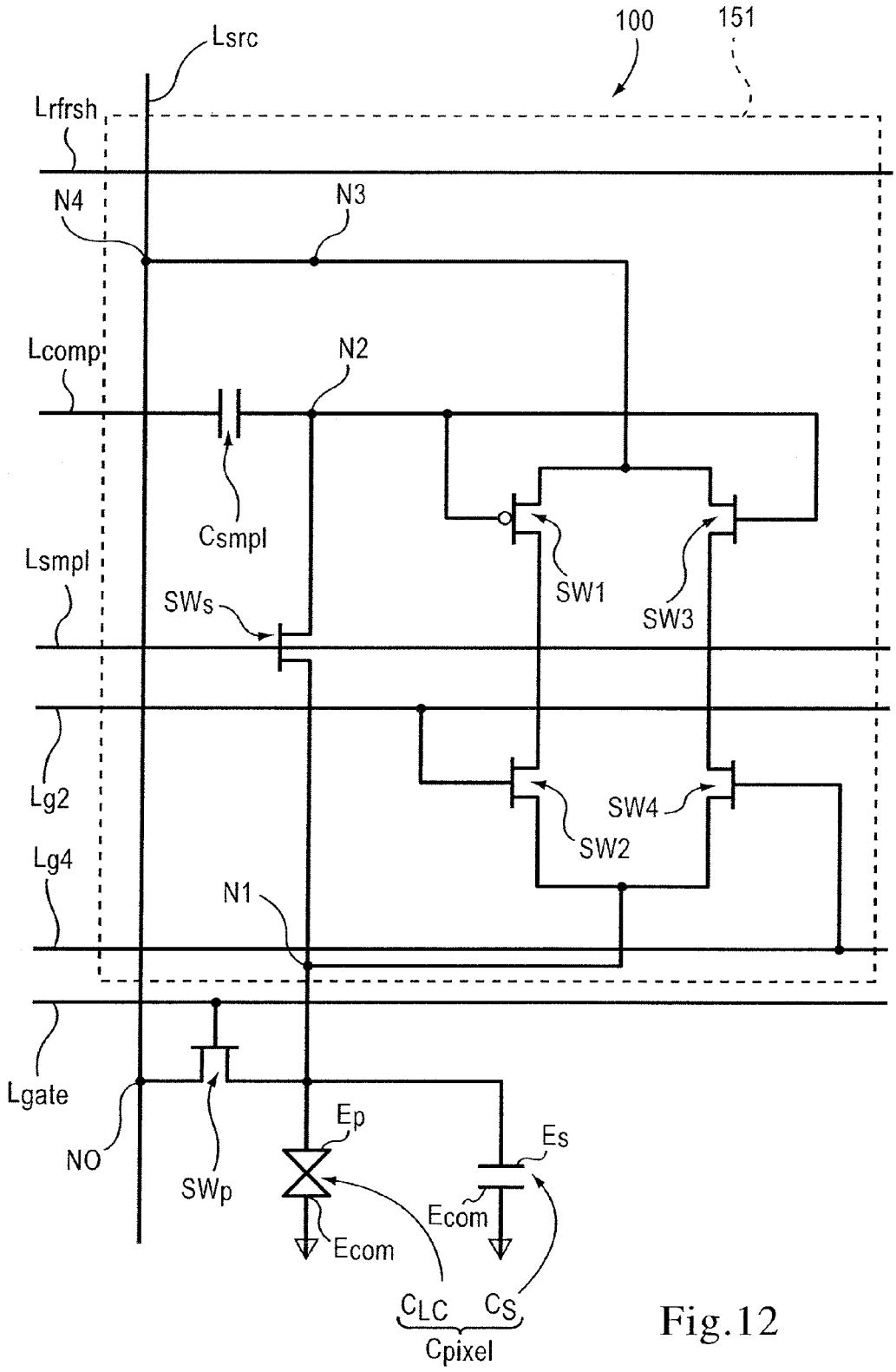
FIG. 12 is a simplified block diagram of the sub-pixel 100 employing a refresh circuit 151 having no refresh switch SWr.

FIG. 11 and FIG. 12 are simplified block diagrams to show the sub-pixels 100 provided with refresh circuits 141 and 151 excluding the refresh switch SWr.

The refresh circuit 141 as shown in FIG. 11 is constructed by deleting the refresh switch SWr from the refresh circuit 121 as shown in FIG. 9 and by directly connecting the node N3 to the node N4. Similarly, the refresh circuit 151 as shown in FIG. 12 is constructed by deleting the refresh switch SWr from the refresh circuit 131 as shown in FIG. 10 and by directly connecting the node N3 to the node N4. The refresh circuits 141 and 151 as shown in FIGS. 11 and 12 operate in basically the same manner as that of the refresh circuit 101 as shown in FIG. 2. As a result, even if the refresh circuits 141 or 151 in FIG. 11 or FIG. 12 may be used, it is possible to drive the gate driver 20 and the source driver 30 at low power consumption.

In FIGS. 11 and 12, the source line Lsrc is directly connected to the switches SW1 and SW3. Consequently, although parasitic capacitance to be connected to the source line Lsrc increases in FIGS. 11 and 12 as compared to that in FIGS. 9 and 10, there is no need for the refresh switch SWr and the refresh line Lrfrsh, which is advantageous for achieving high resolution and miniaturization of the display device 1. It is also possible to modify the refresh circuit 111 as shown in FIG. 7 similar to those in FIGS. 11 and 12.

Although three sub-pixels 100 are combined to construct a single pixel 10 for application to the display device 1 in the above embodiments of the present invention, it is also possible to apply the present invention to a display device in which each sub-pixel 100 constitutes a single pixel (e.g., a monochrome display device).

Moreover, although the above embodiments of the present invention have been described in case of combining three sub-pixels 100 to construct a single pixel 10 for application to the display device 1, it is also possible to apply the present invention to a display device having two or four or more sub-pixels 100 combined together to construct a single pixel 10.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A display device for displaying images by supplying voltages to first and second electrodes, wherein:

the display device comprises a plurality of sub-pixels, a gate driver and a source driver, each sub-pixel is provided with a refresh circuit, the refresh circuit has a voltage selection unit for receiving first and second refresh voltages, and the voltage selection circuit has a first switch, a second switch, a third switch and a fourth switch; and the voltage selection unit is electrically connected with the gate driver and supplies the first refresh voltage to the first electrode through a first path when the voltage on the first electrode is a first data voltage, while supplying the second refresh voltage to the first electrode through a second path when the voltage on the first electrode is a second data voltage, wherein a gate terminal of the first switch and a gate terminal of the third switch are connected to one end of a sample capacitor, and a gate terminal of the second switch and a gate terminal of the fourth switch are electrically connected with the gate driver through a first control line and a second control line, respectively; and wherein another end of the sample capacitor is connected to a refresh switch, and the refresh switch is electrically connected to the gate driver through a refresh line and is electrically connected to the source driver through a source line.

2. A display device of claim 1, wherein the voltage selection unit has the first path and the second path.

3. A display device of claim 2, wherein the voltage selection unit is prevented from supplying the first and second refresh voltages to the first electrode when the voltage on the first electrode is a third data voltage.

4. A display device of claim 3, wherein the first path has the first and the second switches, while the second path has the third and the fourth switches.

5. A display device of claim 4, wherein the display device further comprises a memory unit for memorizing the absolute value of the voltage on the first electrode with respect to the voltage on the second electrode, and the polarity of the voltage on the first electrode with respect to the voltage on the second electrode, wherein the first and third switches are controlled based on the absolute value and the polarity that are memorized in the memory unit.

6. A display device of claim 4, wherein the refresh circuit further comprises:

a sample switch electrically connected to the gate driver through a sample line, and another terminal of the sample switch is connected with the voltage selection unit.

7. A display device of claim 6, wherein each sub-pixel further comprises:

a liquid crystal capacitance electrically connected to the sample switch;

a storage capacitance electrically connected to the liquid crystal capacitance; and a sub-pixel switch electrically connected to the gate driver through a gate line.

8. A display device for displaying images by supplying voltages to first and second electrodes, wherein:

the display device comprises a plurality of sub-pixels, a gate driver and a source driver, each sub-pixel is provided with a refresh circuit, and the refresh circuit has a voltage selection unit for receiving first and second refresh voltages, and the voltage selection circuit has a first switch, a second switch, a third switch and a fourth switch; and the voltage selection unit is electrically connected with the gate driver and supplies the first refresh voltage to the first electrode through a first path when the voltage on the first electrode is a first data voltage, while supplying the second refresh voltage to the first electrode through a second path when the voltage on the first electrode is a second data voltage, wherein a gate terminal of the first switch and a gate terminal of the third switch are connected to one end of a sample capacitor, and a gate terminal of the second switch and a gate terminal of the fourth switch are electrically connected with the gate driver through a first control line and a second control line, respectively, wherein another end of the sample capacitor is connected to a compensation line.

9. A display device for displaying images by supplying voltages to first and second electrodes, wherein:

the display device comprises a plurality of sub-pixels, a gate driver and a source driver, each sub-pixel is provided with a refresh circuit, and the refresh circuit has a voltage selection unit for receiving first and second refresh voltages, and the voltage selection circuit has a first switch, a second switch, a third switch and a fourth switch; and the voltage selection unit is electrically connected with the gate driver and supplies the first refresh voltage to the first electrode through a first path when the voltage on the first electrode is a first data voltage, while supplying the second refresh voltage to the first electrode through a second path when the voltage on the first electrode is a second data voltage, wherein a gate terminal of the first switch and a gate terminal of the third switch are connected to one end of a sample capacitor, and a gate terminal of the second switch and a gate terminal of the fourth switch are electrically connected with the gate driver through a first control line and a second control line, respectively, wherein another end of the sample capacitor is connected to the source driver through a source line.

* * * * *